US012442603B2

(12) United States Patent
Moore et al.

(10) Patent No.: US 12,442,603 B2
(45) Date of Patent: Oct. 14, 2025

(54) LEVER ACTION FIREARMS HAVING GEAR ASSEMBLIES AND LINKAGE ASSEMBLIES FOR CONNECTING ITS ACTION LEVER TO ITS BOLT CARRIER ASSEMBLY AND ASSOCIATED METHODS

(71) Applicant: Bear Creek Arsenal, LLC

(72) Inventors: Chadwick Eugene Moore, Siler City, NC (US); Peter Austin Karstaedt, Sanford, NC (US); William Randal Hardee, III, Sanford, NC (US)

(73) Assignee: Bear Creek Arsenal, LLC, Sanford, NC (US)

( * ) Notice: Subject to any disclaimer, the term of this patent is extended or adjusted under 35 U.S.C. 154(b) by 0 days.

(21) Appl. No.: 18/945,066

(22) Filed: Nov. 12, 2024

(65) Prior Publication Data

US 2025/0155209 A1 May 15, 2025

Related U.S. Application Data

(60) Provisional application No. 63/547,880, filed on Nov. 9, 2023.

(51) Int. Cl.
*F41A 3/72* (2006.01)
*F41A 3/66* (2006.01)
(Continued)

(52) U.S. Cl.
CPC *F41A 3/72* (2013.01); *F41A 3/66* (2013.01); *F41A 17/38* (2013.01); *F41A 19/45* (2013.01); *F41C 7/06* (2013.01)

(58) Field of Classification Search
CPC ..... F41A 3/18; F41A 3/22; F41C 7/06
See application file for complete search history.

(56) References Cited

U.S. PATENT DOCUMENTS 3,377,731 A * 4/1968 Lawrence ..... F41C 7/06 42/20
3,471,961 A * 10/1969 Lewis ..... F41A 3/18 42/20

(Continued)

OTHER PUBLICATIONS

PCT Search Report and Written Opinion for corresponding PCT International Application No. PCT/US2024/055520 dated Aug. 26, 2025.

*Primary Examiner* — Reginald S Tillman, Jr.
(74) *Attorney, Agent, or Firm* — Olive Law Group, PLLC

(57) ABSTRACT

Lever action firearms having a linkage assembly for pivotally connecting its action lever to its bolt carrier assembly and associated methods are disclosed. The lever action firearm includes a bolt carrier assembly received in an upper frame and operable to reciprocate between an open position and a closed position. The bolt carrier assembly includes a first pivot. A lower frame defines a magazine well configured to removably receive a box magazine. The lever action firearm includes an action lever movable between a retracted position and an extended position. The action lever includes second and third pivots. The action lever is pivotally connected to the lower frame at the second pivot. The lever action firearm also includes a linkage assembly is pivotally connected to the action lever at the third pivot, wherein the linkage assembly is pivotally connected to the bolt carrier assembly at the first pivot.

17 Claims, 30 Drawing Sheets

(51) Int. Cl.

| | |
|---|---|
| ***F41A 17/38*** | (2006.01) |
| ***F41A 19/45*** | (2006.01) |
| ***F41C 7/06*** | (2006.01) |

(56) References Cited

U.S. PATENT DOCUMENTS

| | | | | |
|---|---|---|---|---|
| 5,148,619 | A * | 9/1992 | Badali | F41C 7/06<br>42/20 |
| 8,109,025 | B2 | 2/2012 | Stone | |
| 9,328,990 | B2 * | 5/2016 | Giannelli | F41C 7/06 |
| 9,625,231 | B1 * | 4/2017 | Hass | F41C 7/06 |
| 12,152,844 | B2 * | 11/2024 | Herring | F41A 3/66 |
| 2023/0304755 | A1 | 9/2023 | Tusting et al. | |

* cited by examiner

LEVER ACTION FIREARMS HAVING GEAR ASSEMBLIES AND LINKAGE ASSEMBLIES FOR CONNECTING ITS ACTION LEVER TO ITS BOLT CARRIER ASSEMBLY AND ASSOCIATED METHODS

CROSS REFERENCE TO RELATED APPLICATION

This application claims priority to U.S. Provisional Patent Application No. 63/547,880, filed Nov. 9, 2023, and titled LEVER ACTION FIREARMS HAVING A LINKAGE ASSEMBLY FOR PIVOTALLY CONNECTING ITS ACTION LEVER TO ITS BOLT CARRIER ASSEMBLY AND ASSOCIATED METHODS, the disclosure of which is incorporated herein by reference in its entirety.

TECHNICAL FIELD

The presently disclosed subject matter relates generally to firearms. Particularly, the presently disclosed subject matter relates to lever action firearms having gear assemblies and linkage assemblies connecting its action lever to its bolt carrier assembly and associated methods.

BACKGROUND

A lever action rifle is a repeating type of firearm that uses a manually operated cocking handle located around a trigger guard area. The handle pivots forward to move a bolt via internal linkages, which will feed and extract cartridges into and out of the chamber, and cock the firing pin mechanism. Most lever action firearms are rifles, but other lever action firearms include lever action shotguns and pistols.

There is a continuing need for improved customizability for allowing users to switch calibers, triggers, barrels, and muzzle devices with ease.

BRIEF DESCRIPTION OF THE DRAWINGS

Figure 1:
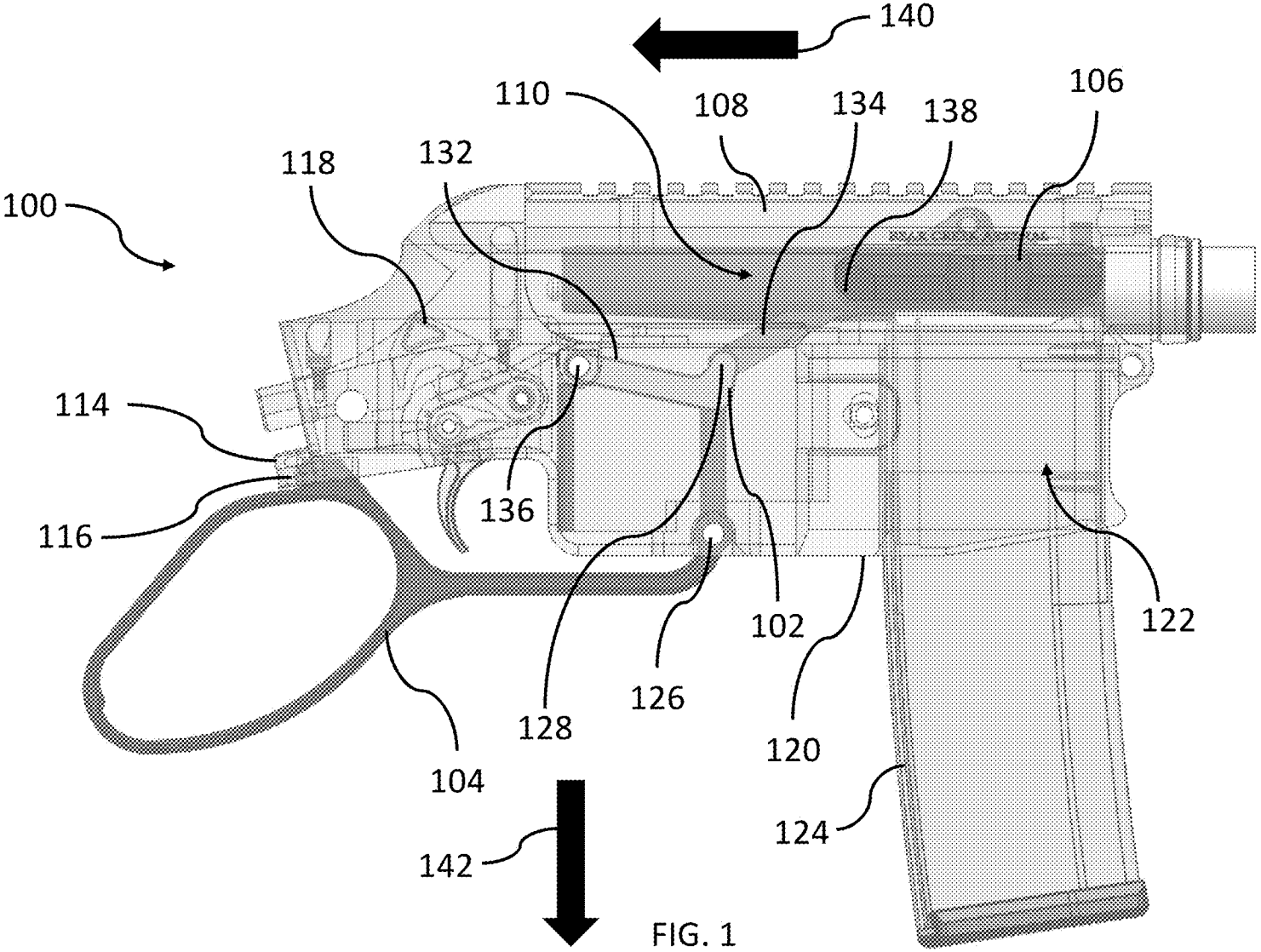
Figure 2:
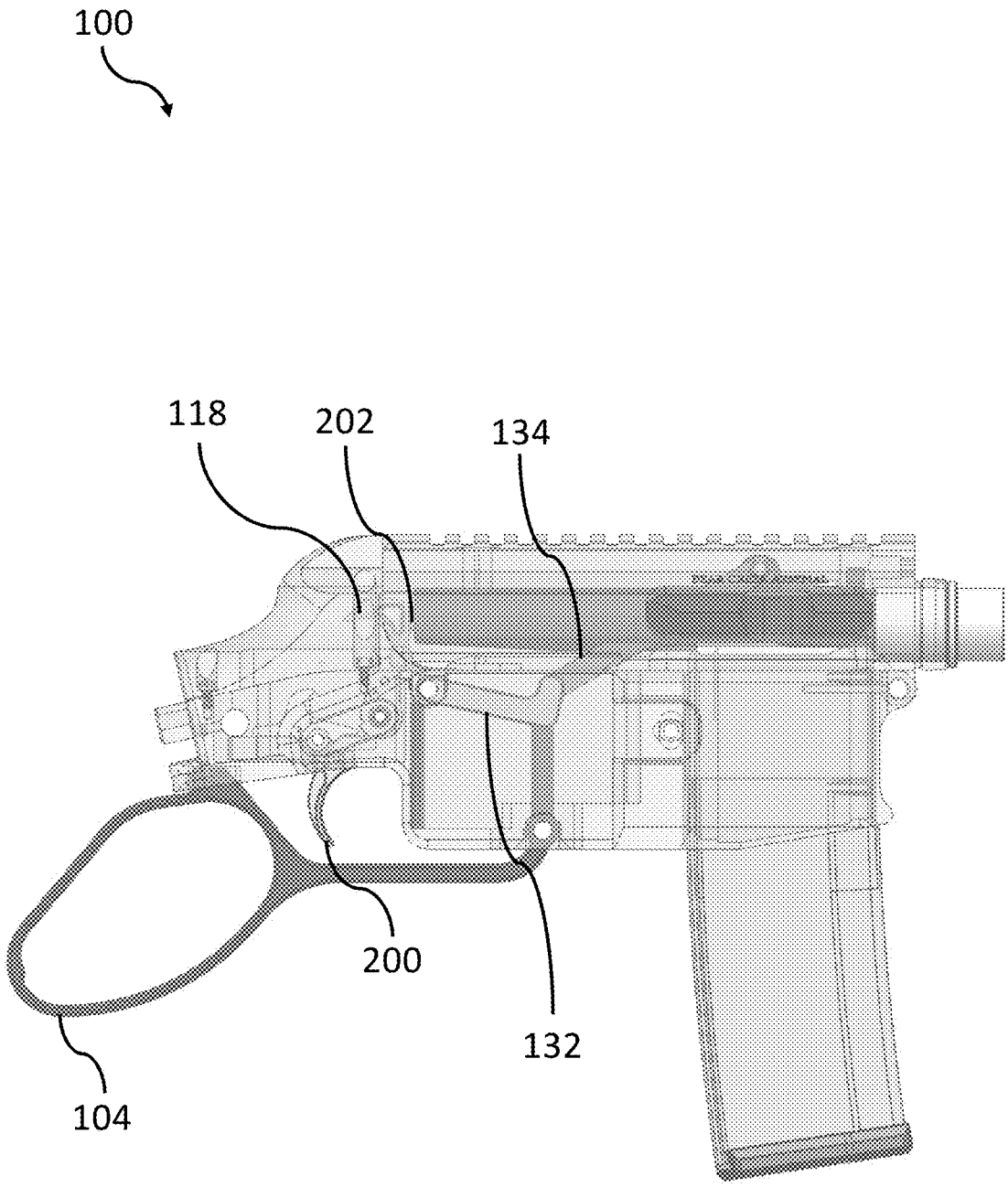
Figure 3:
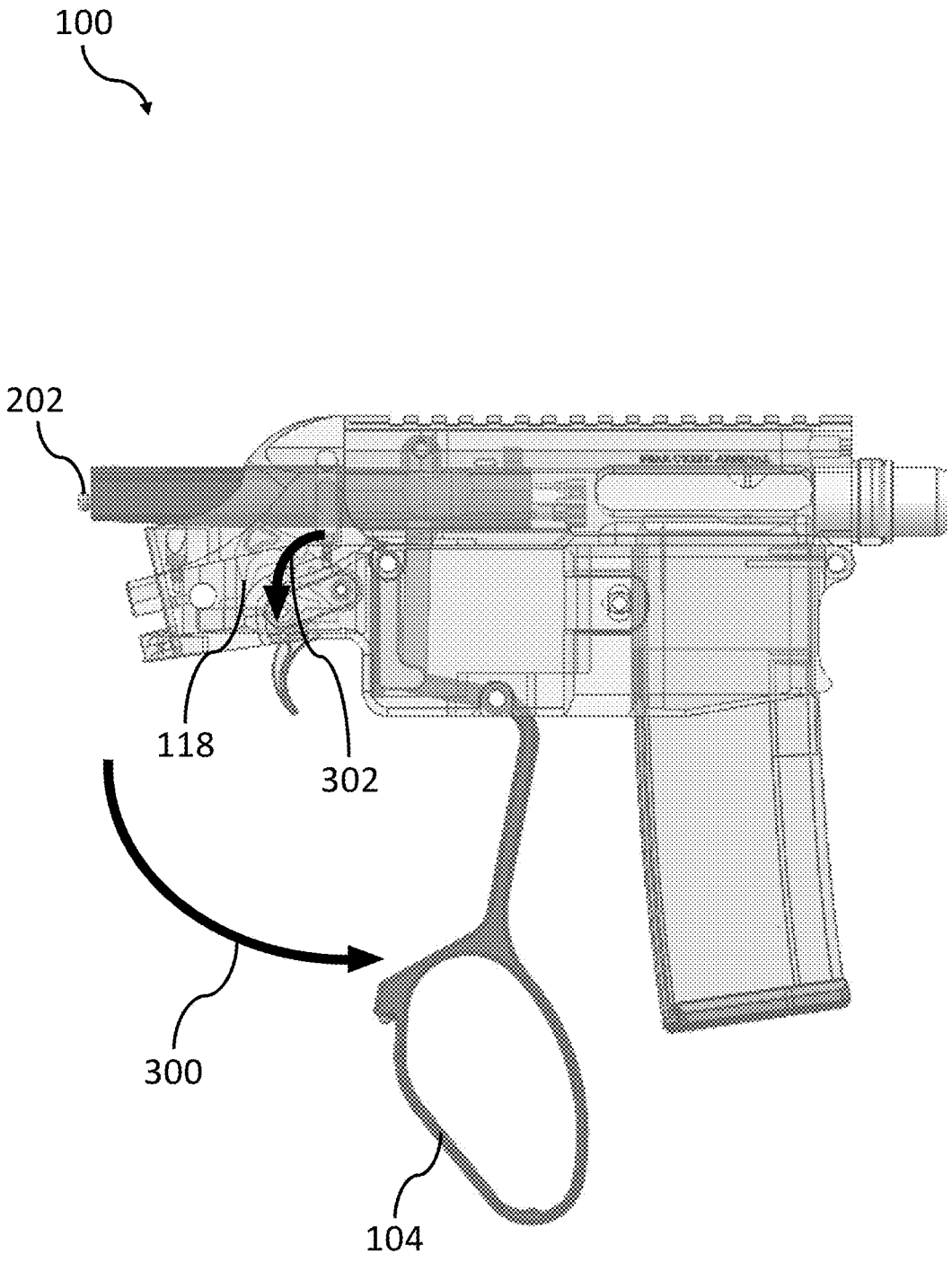
Figure 4:
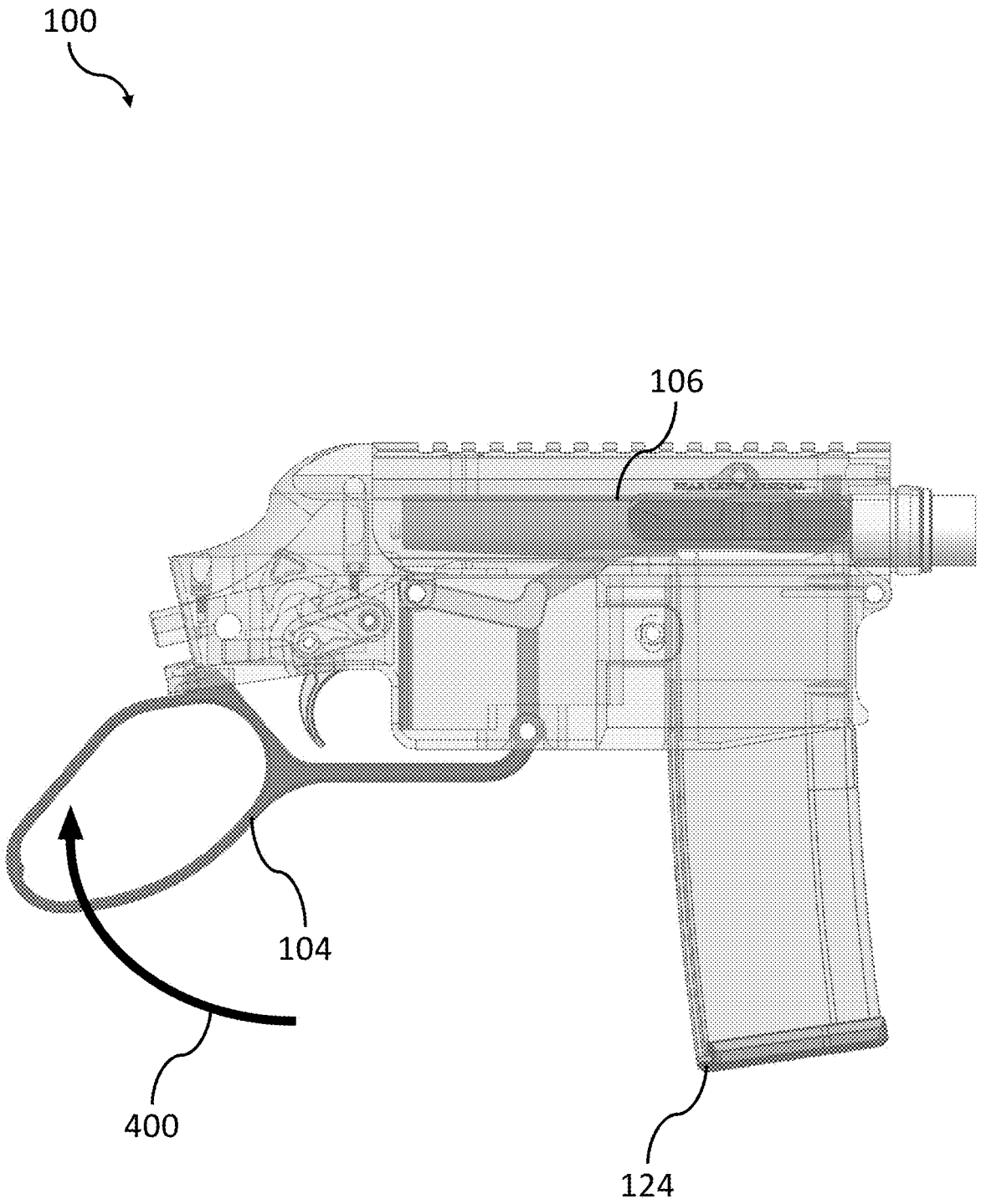
Figure 5:
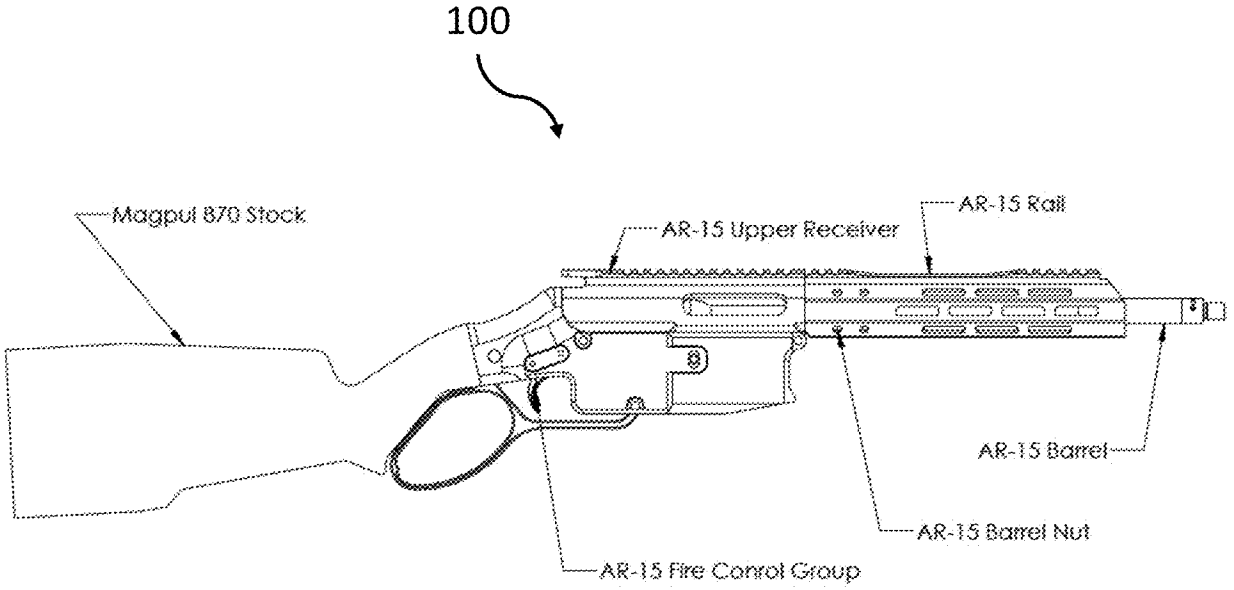
Figure 6:
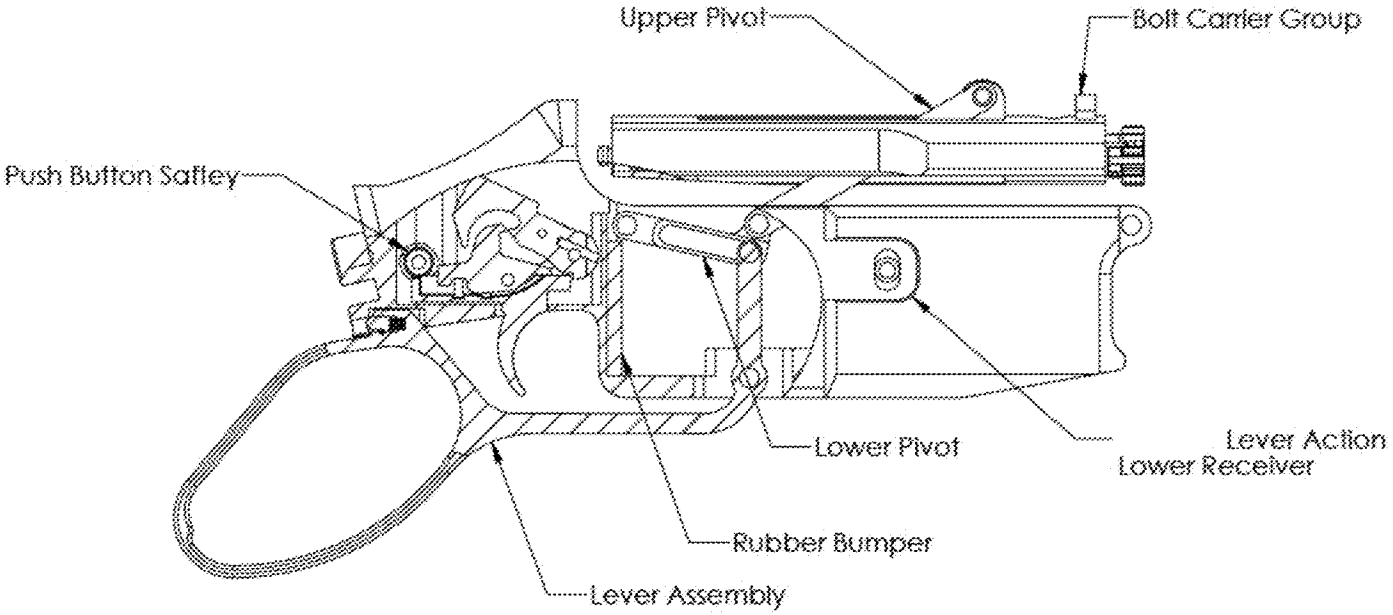
Figure 8:
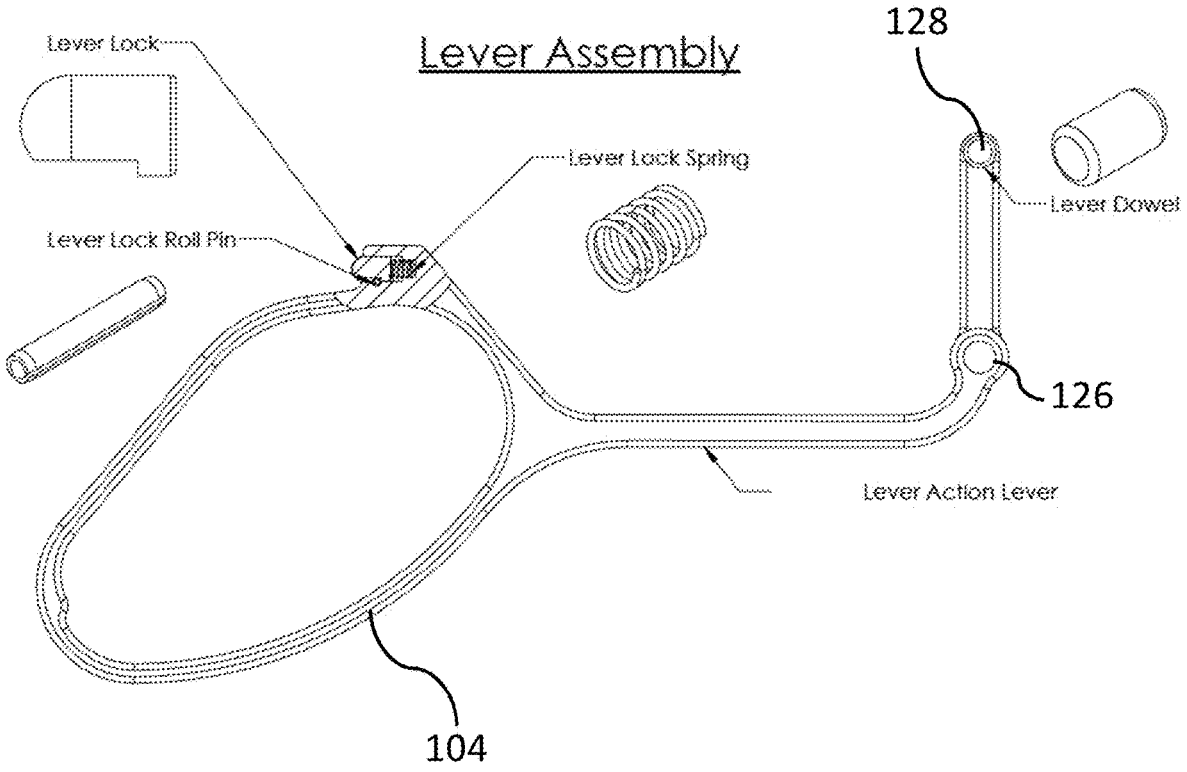
Figure 9:
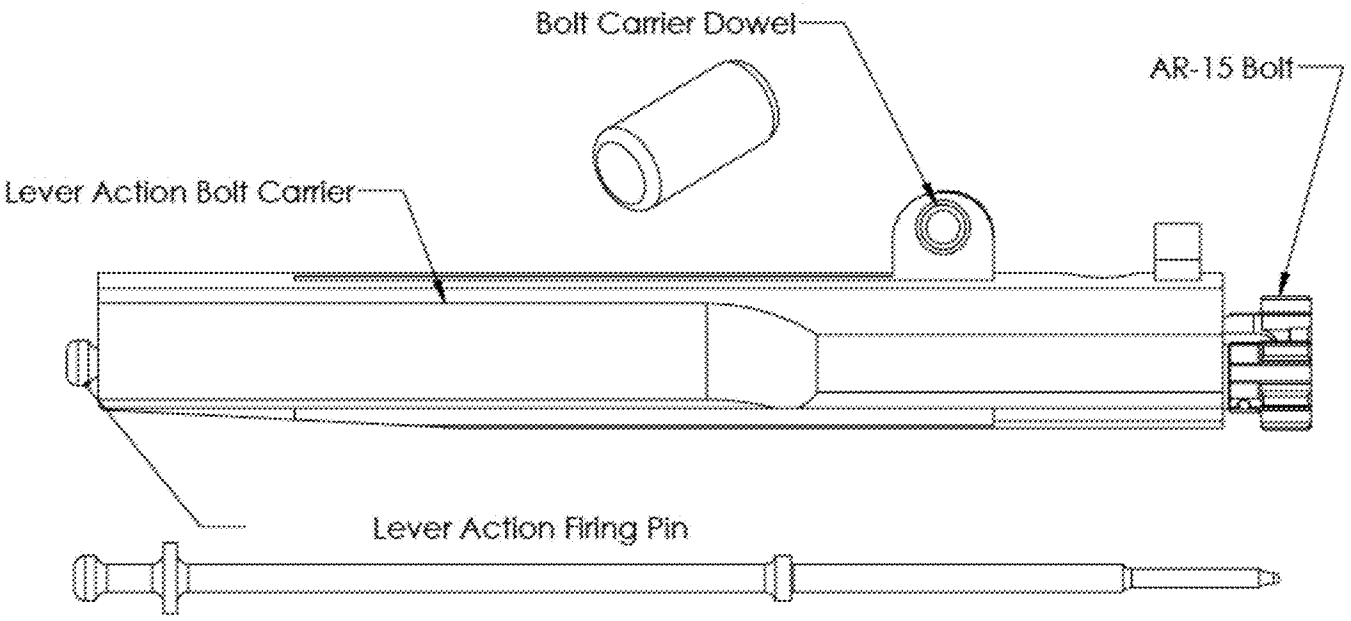
Figure 10:
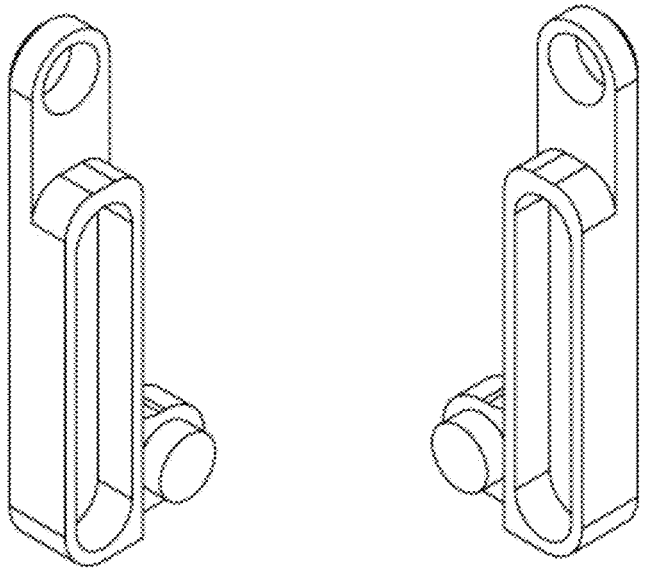
Figure 11:
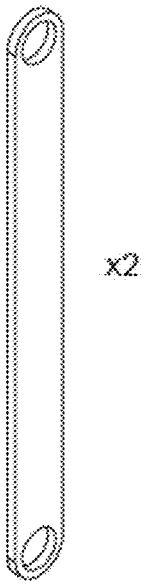
Figure 12:
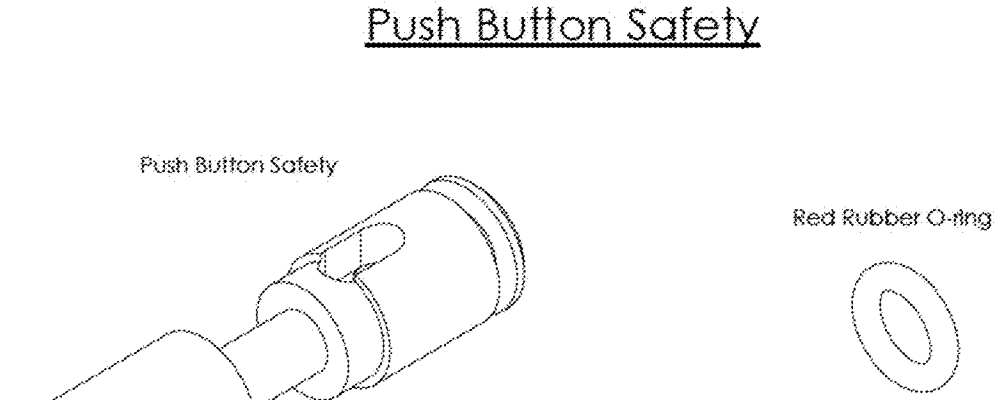
Figure 13:
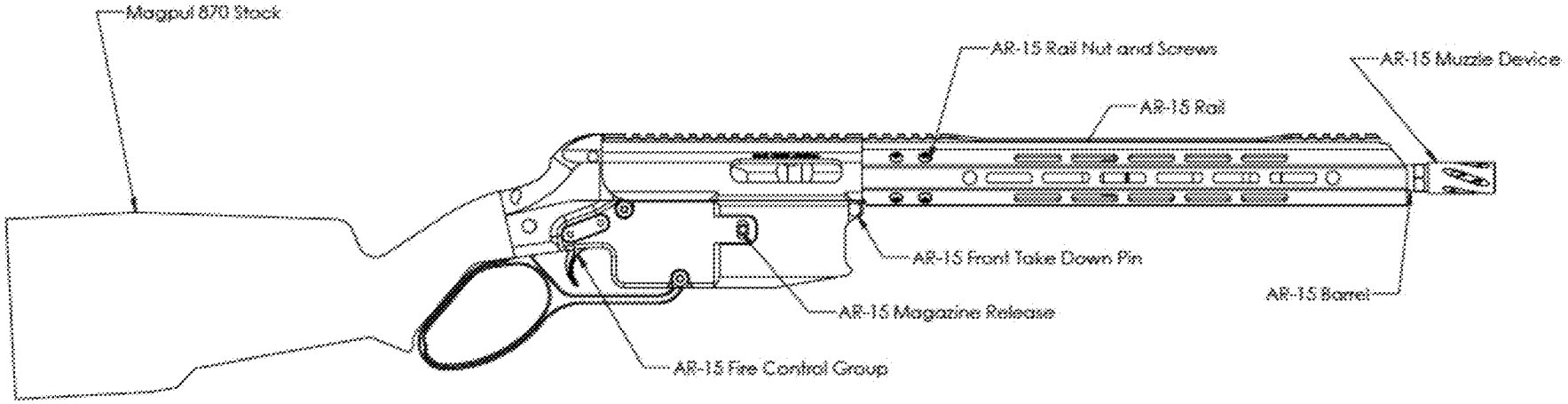
Figure 14:
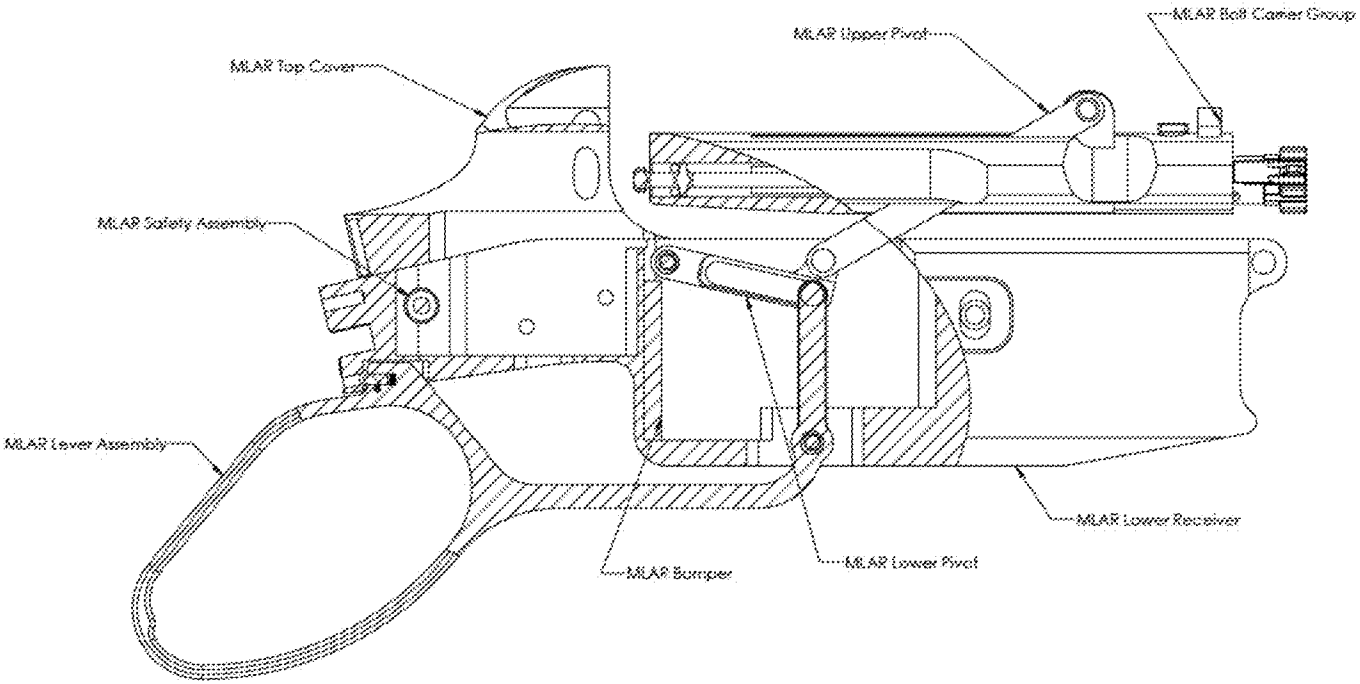
Figure 15:
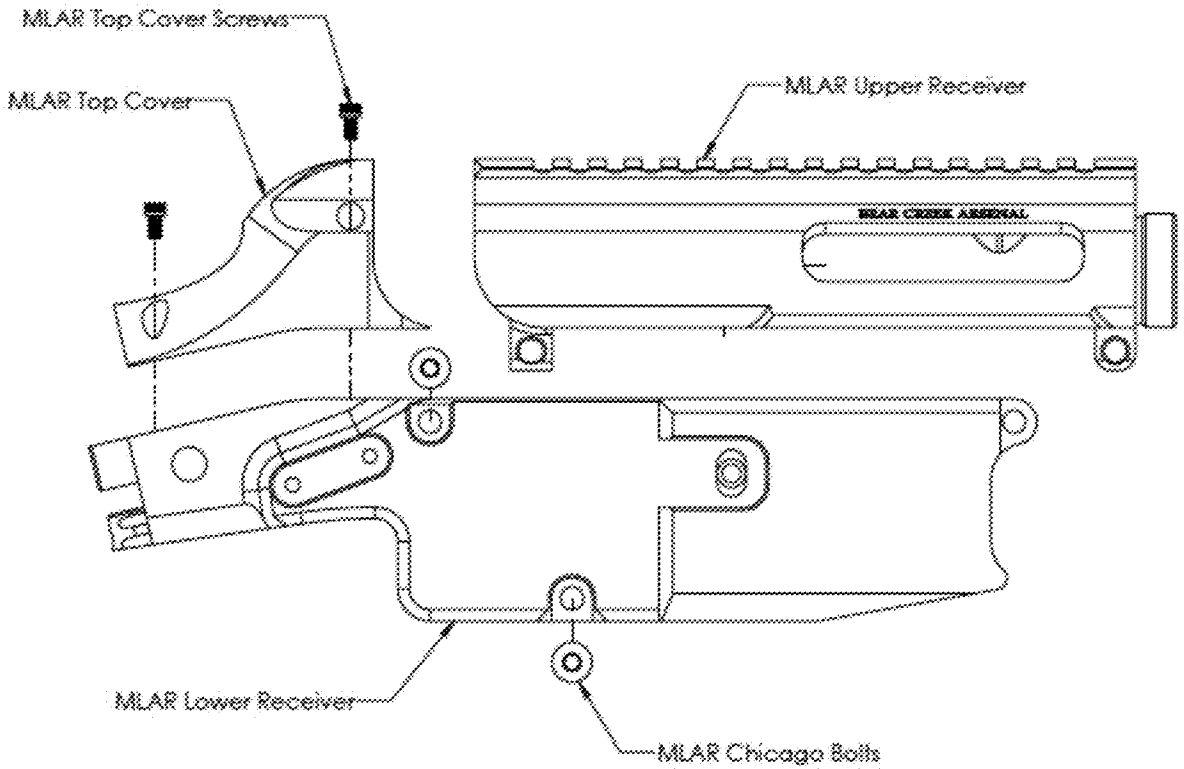
Figure 16:
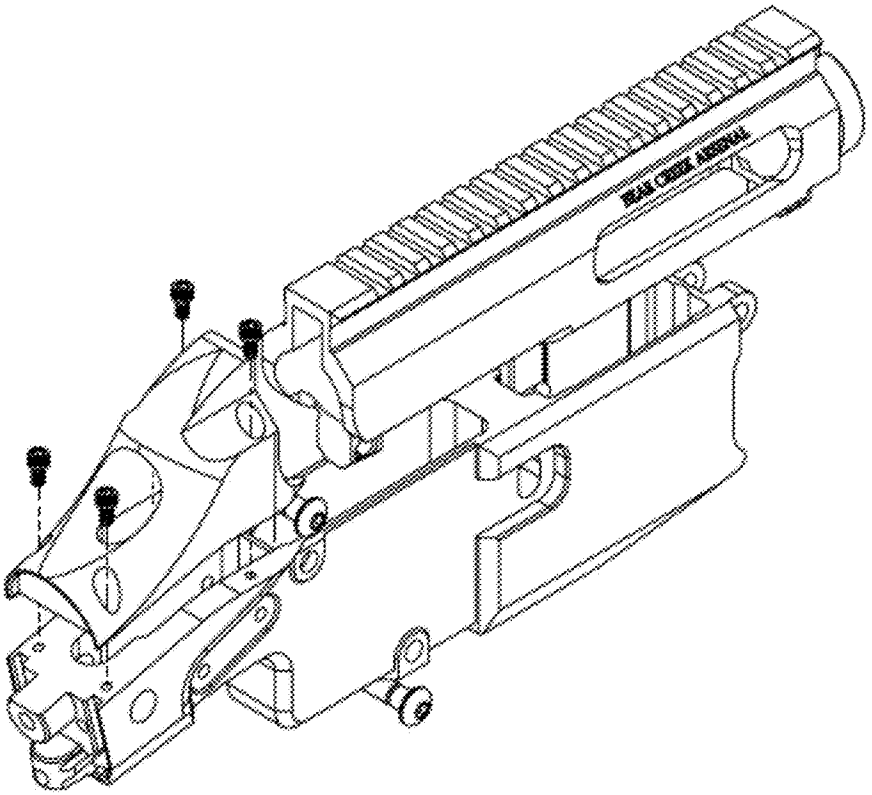
Figure 17A:
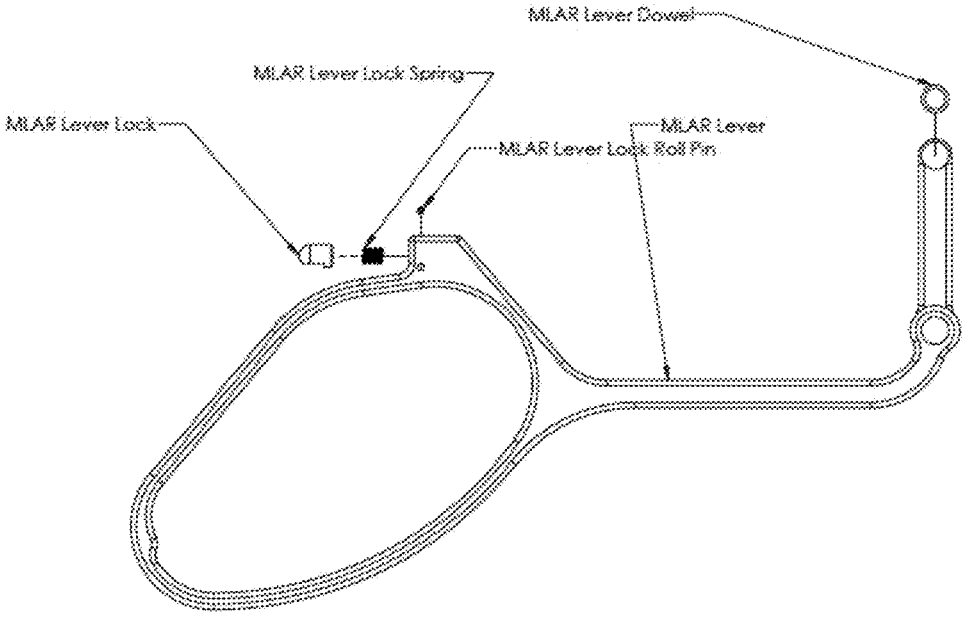
Figure 17B:
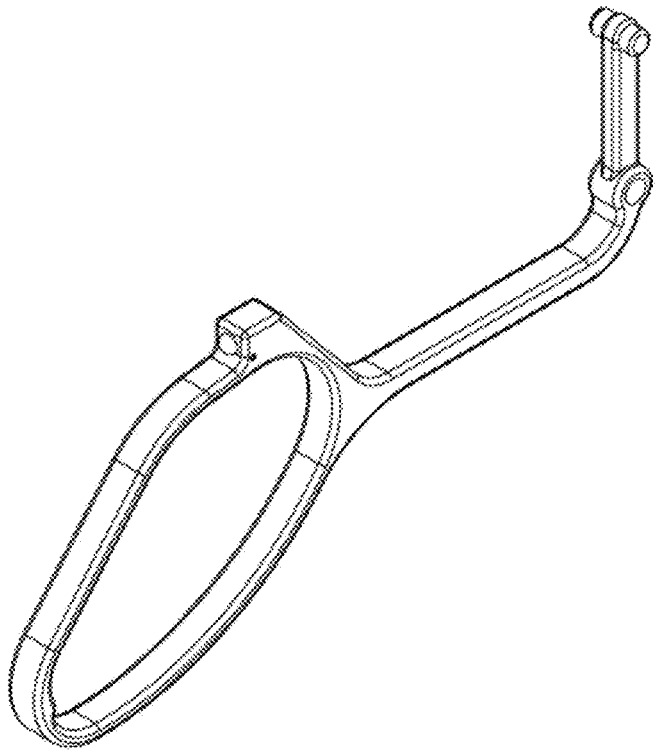
Figure 18:
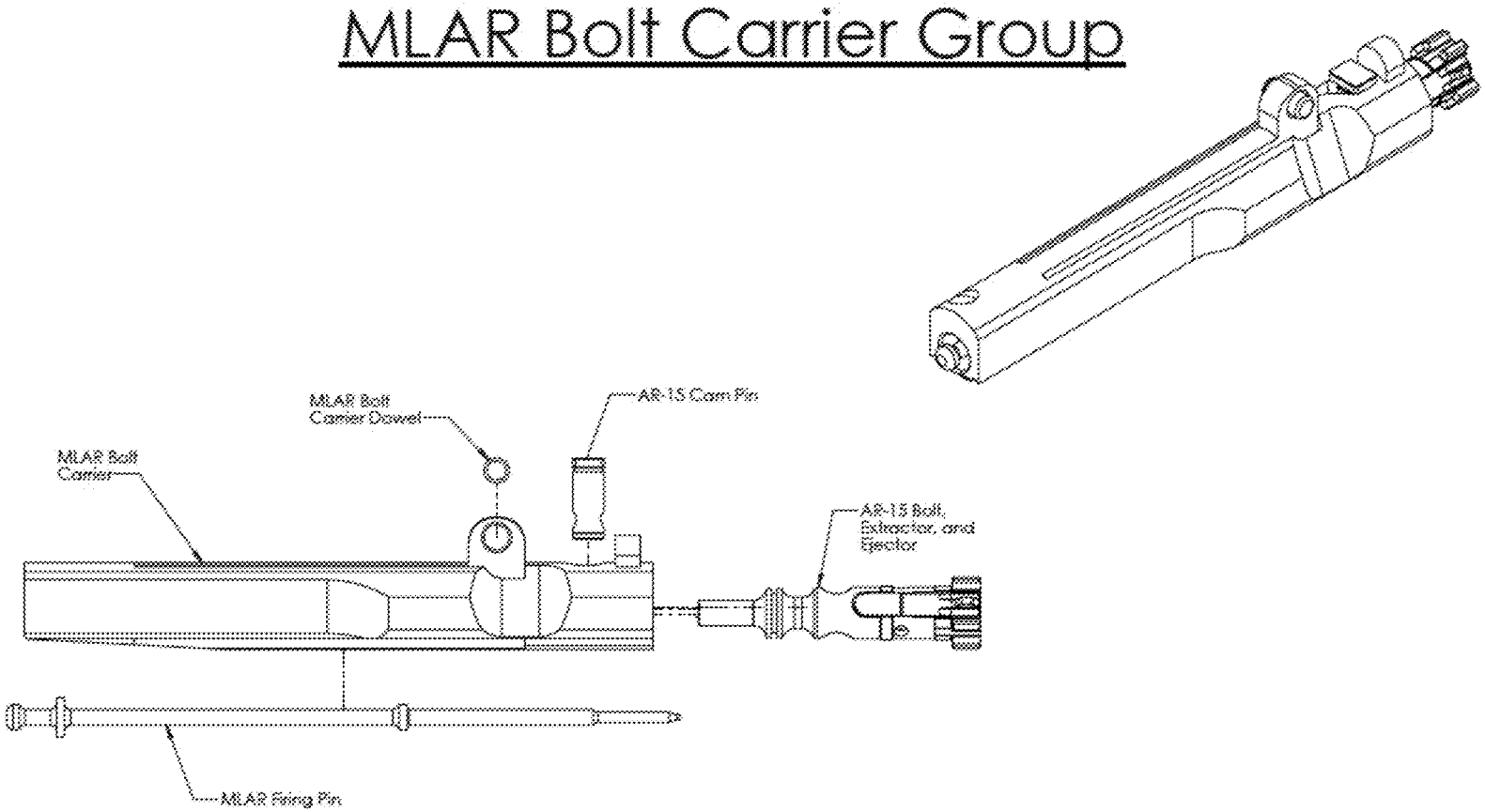
Figure 19:
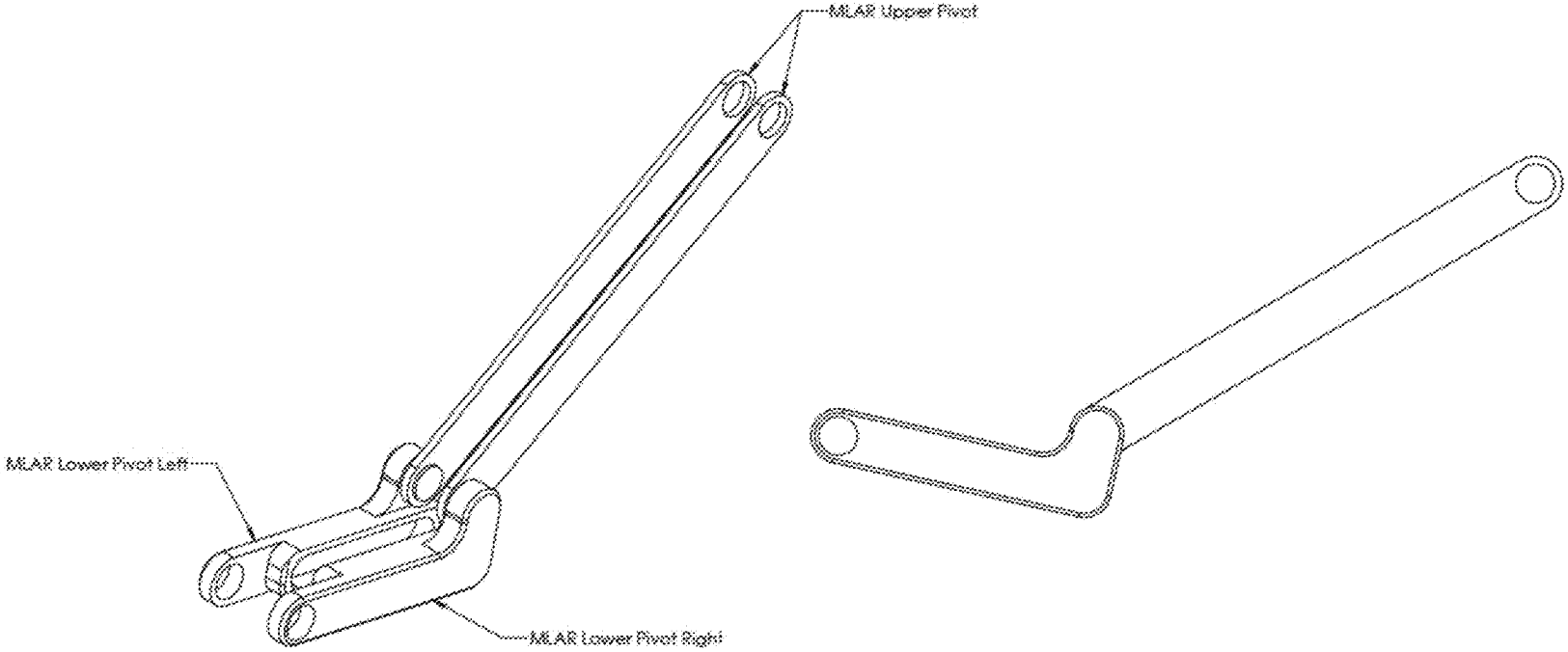
Figure 20:
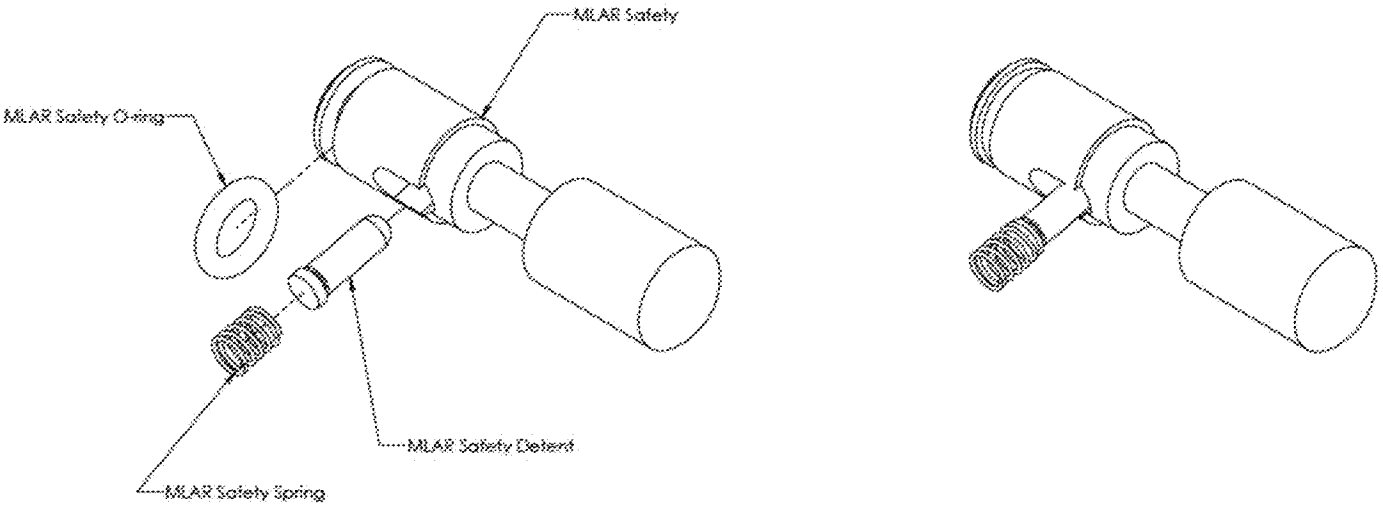
Figure 21:
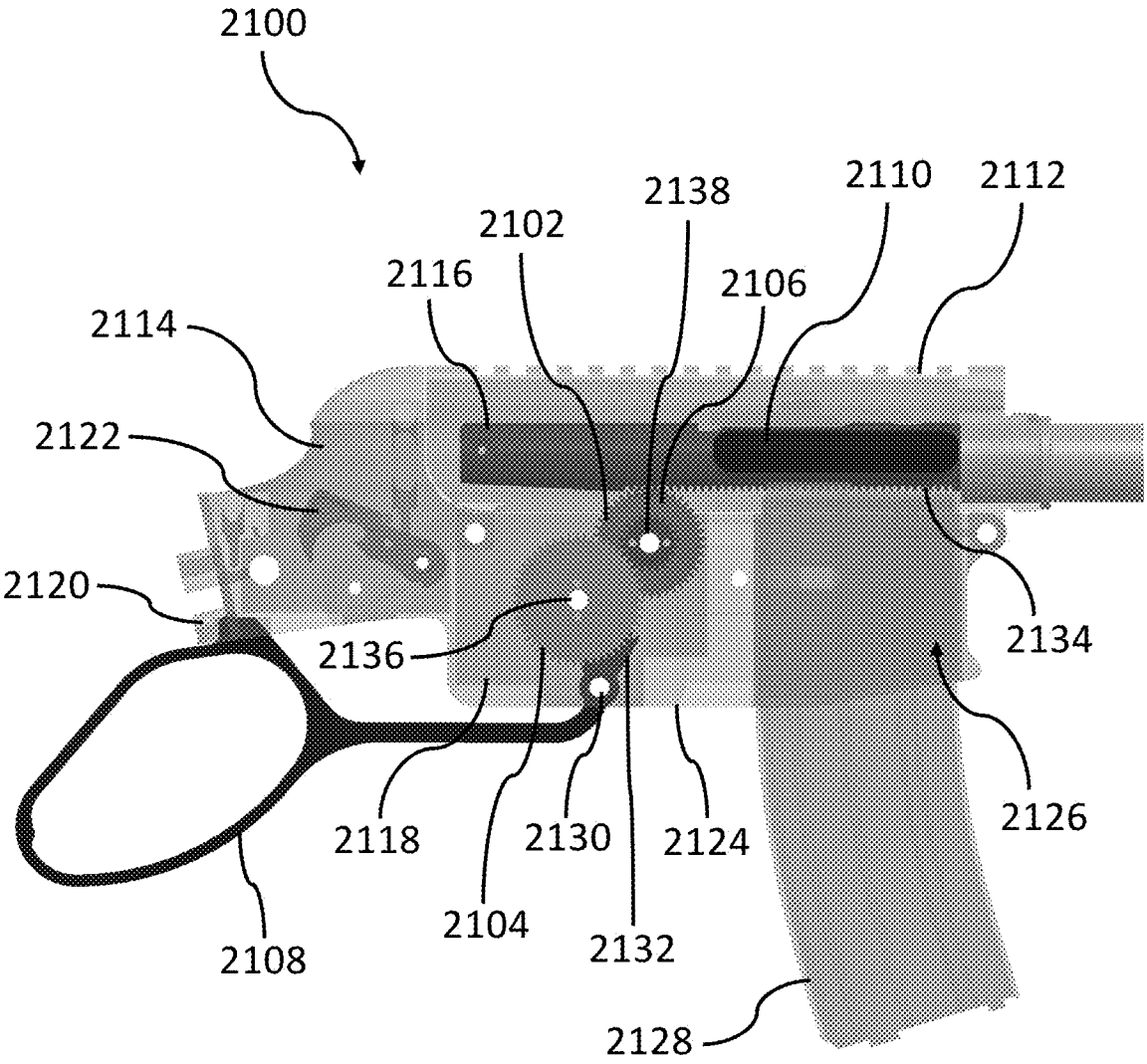
Figure 22:
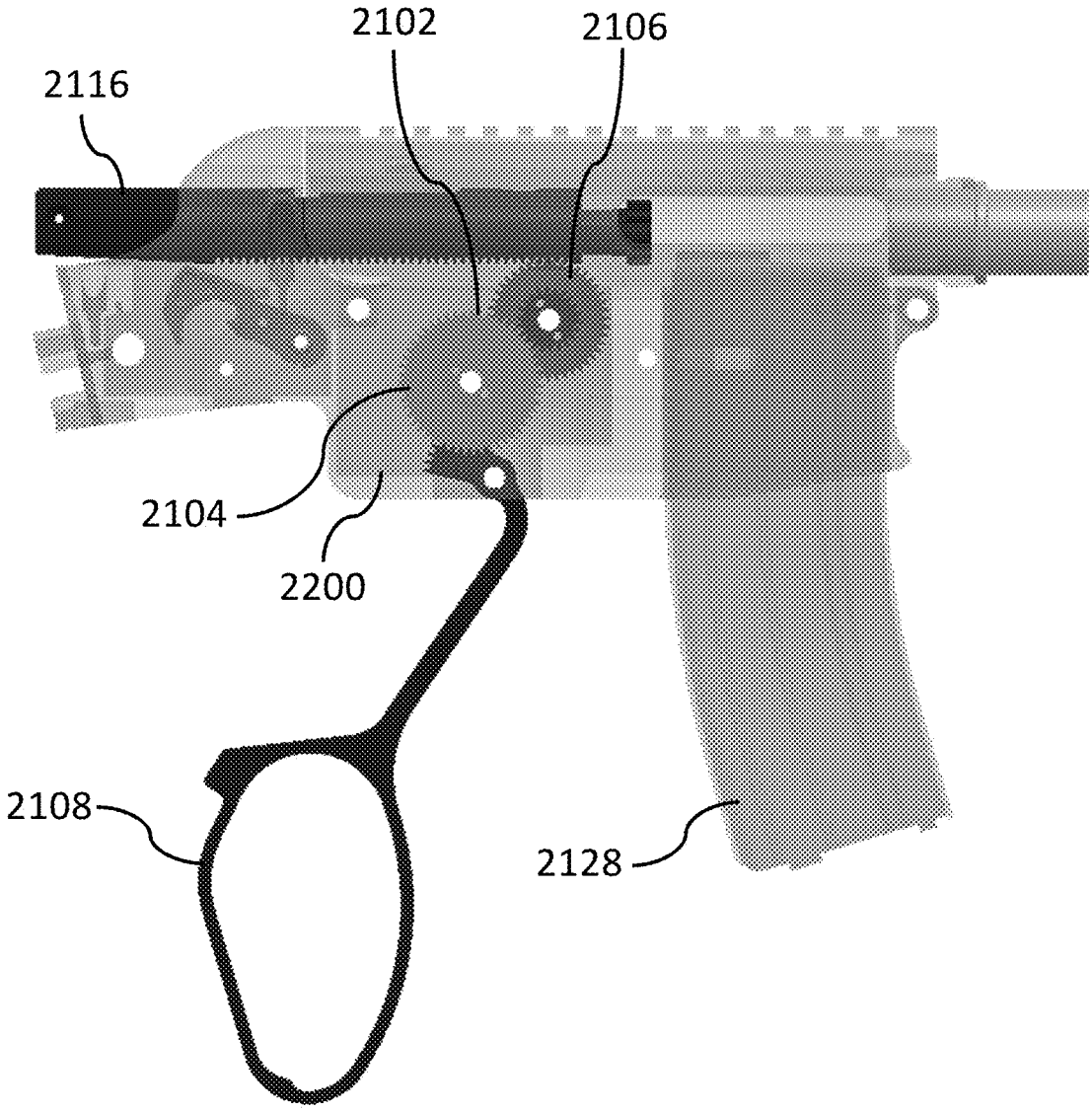
Figure 23:
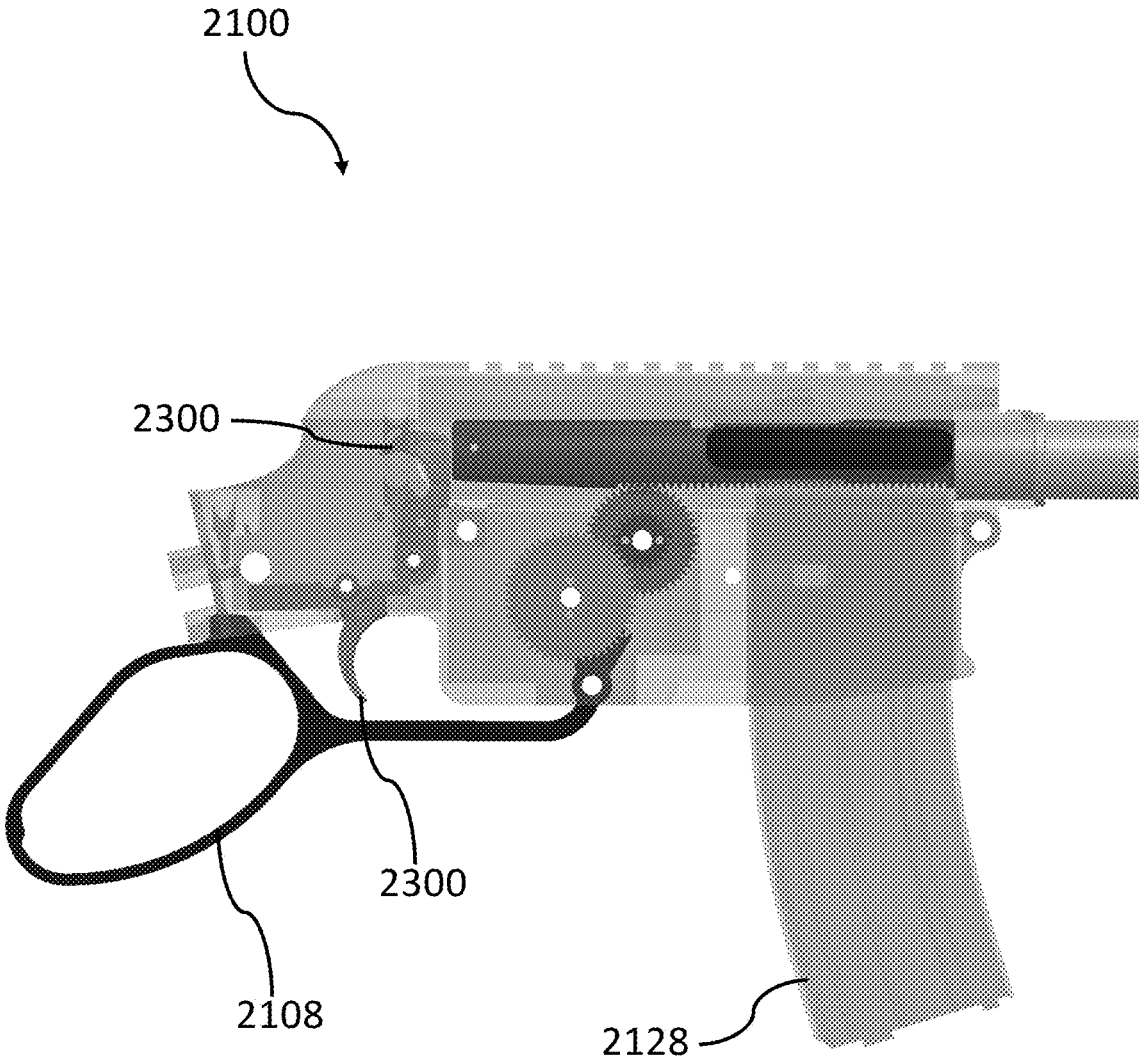
Figure 24:
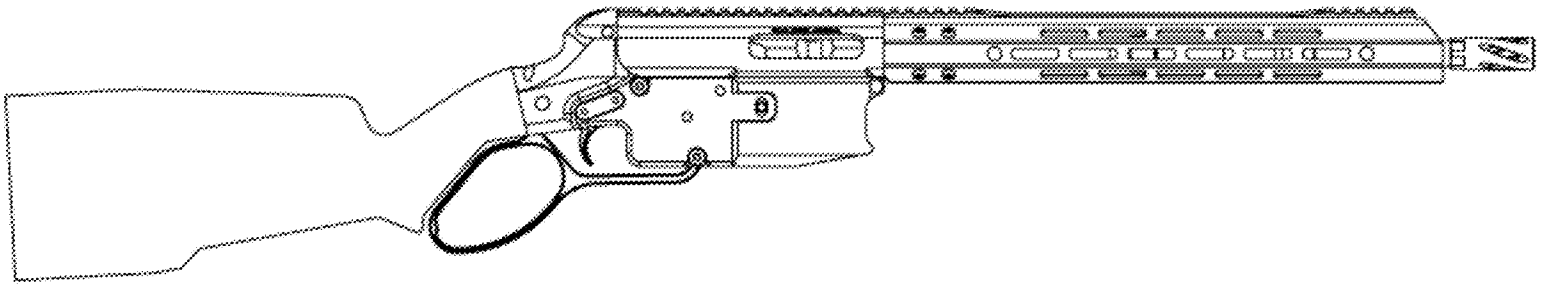
Figure 25:
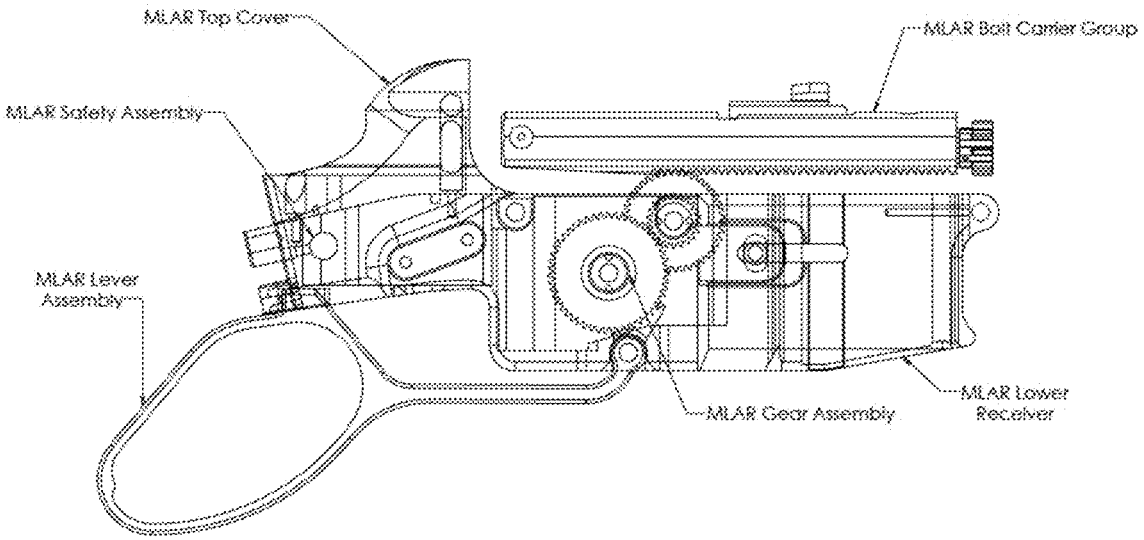
Figure 26:
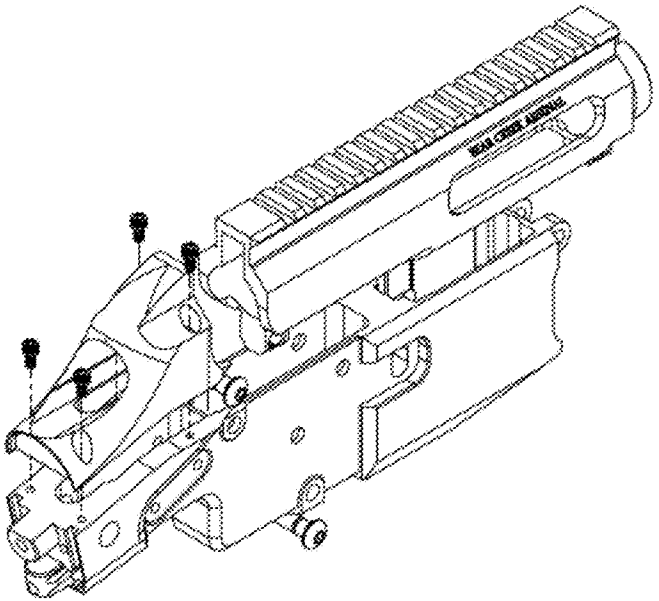
Figure 26:
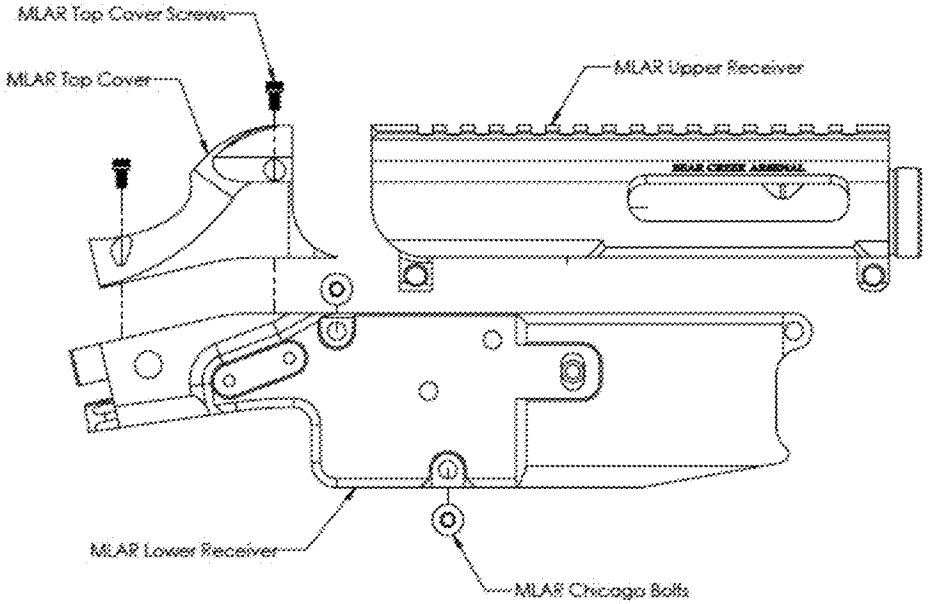
Figure 27:
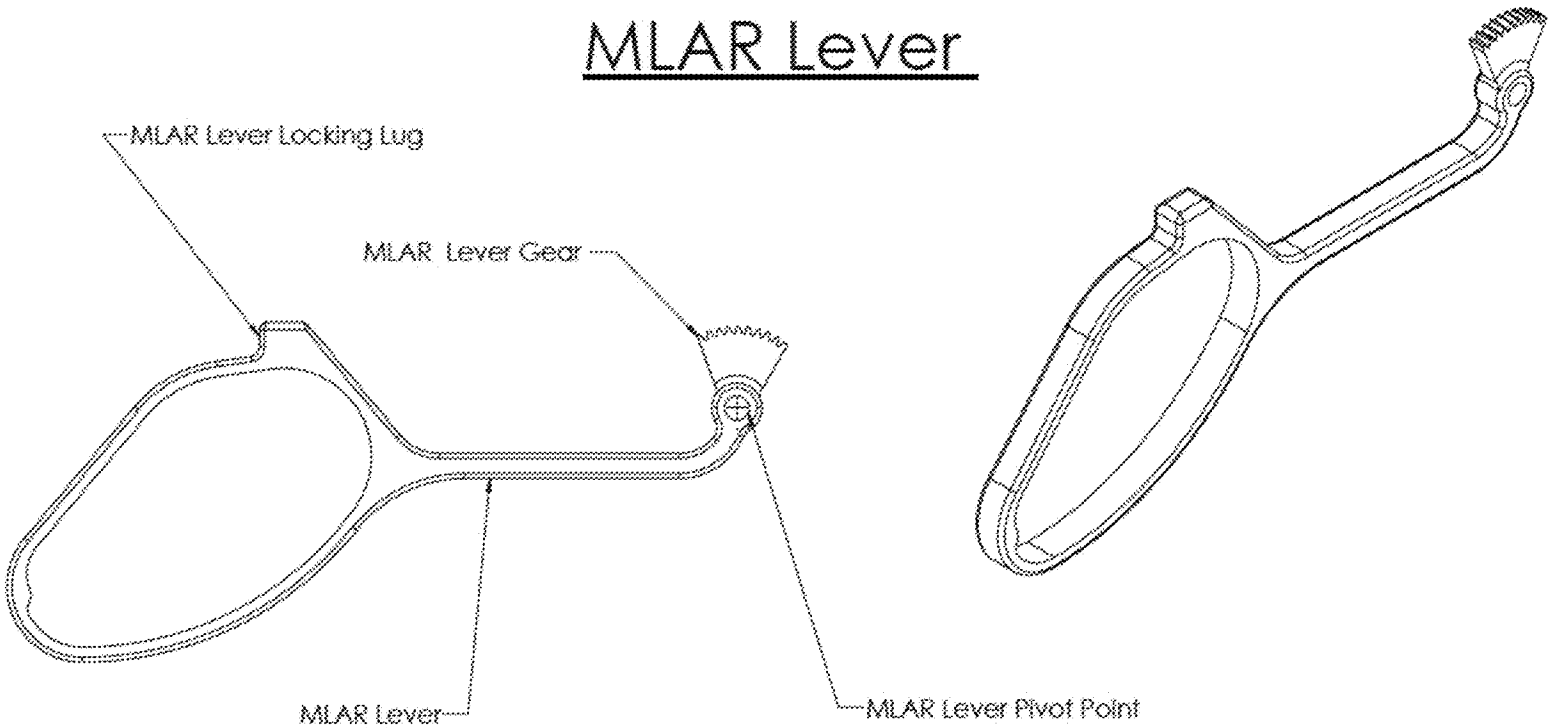
Figure 28:
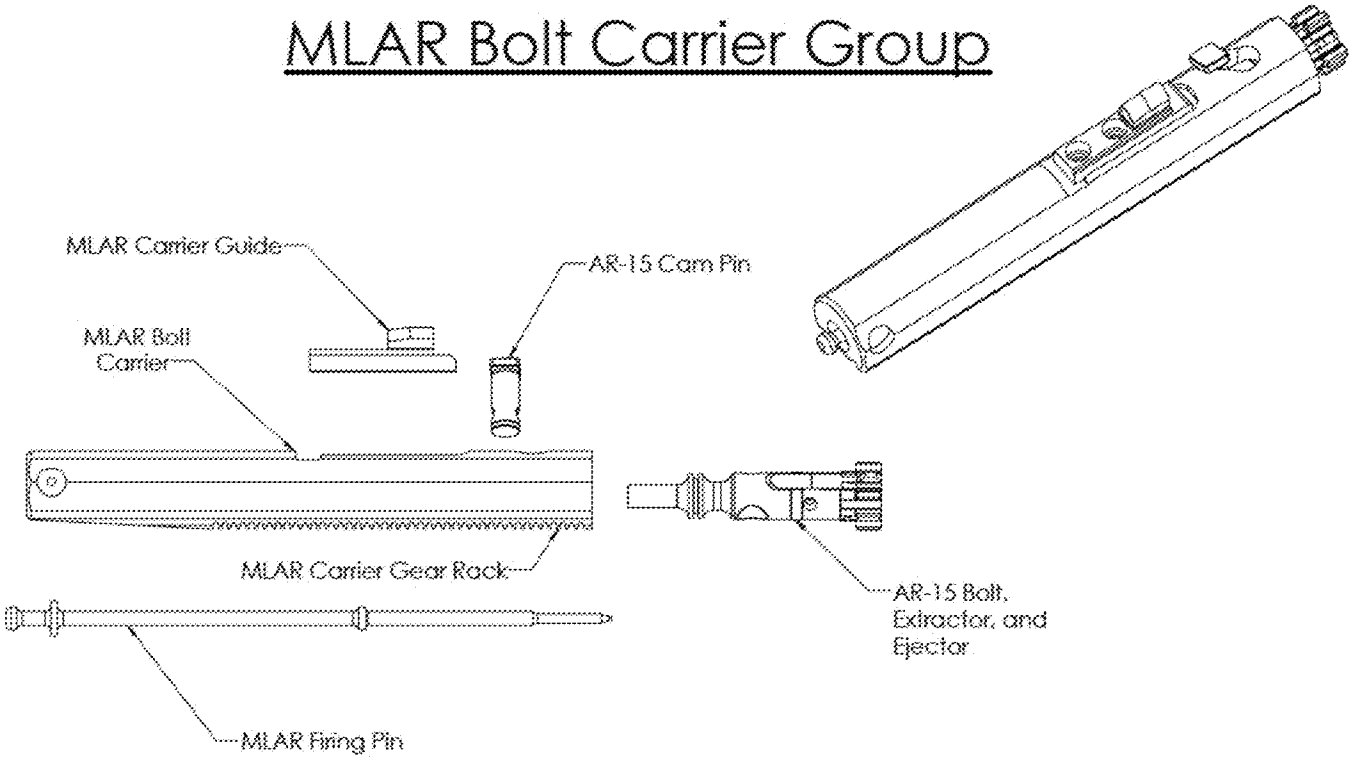
Figure 29:
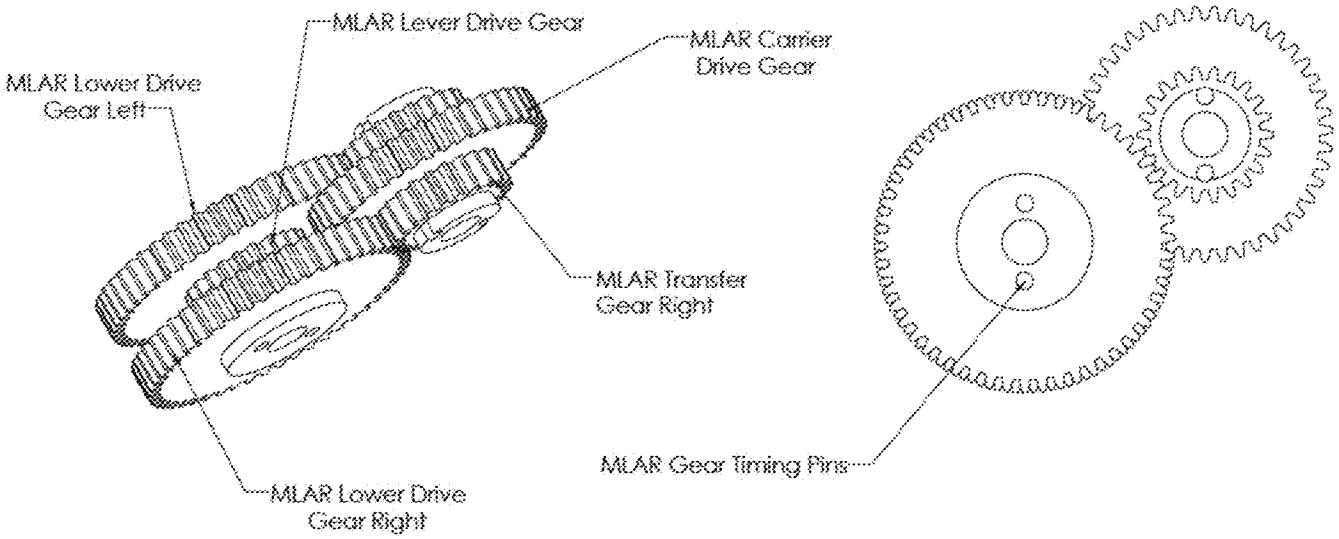
Figure 30:
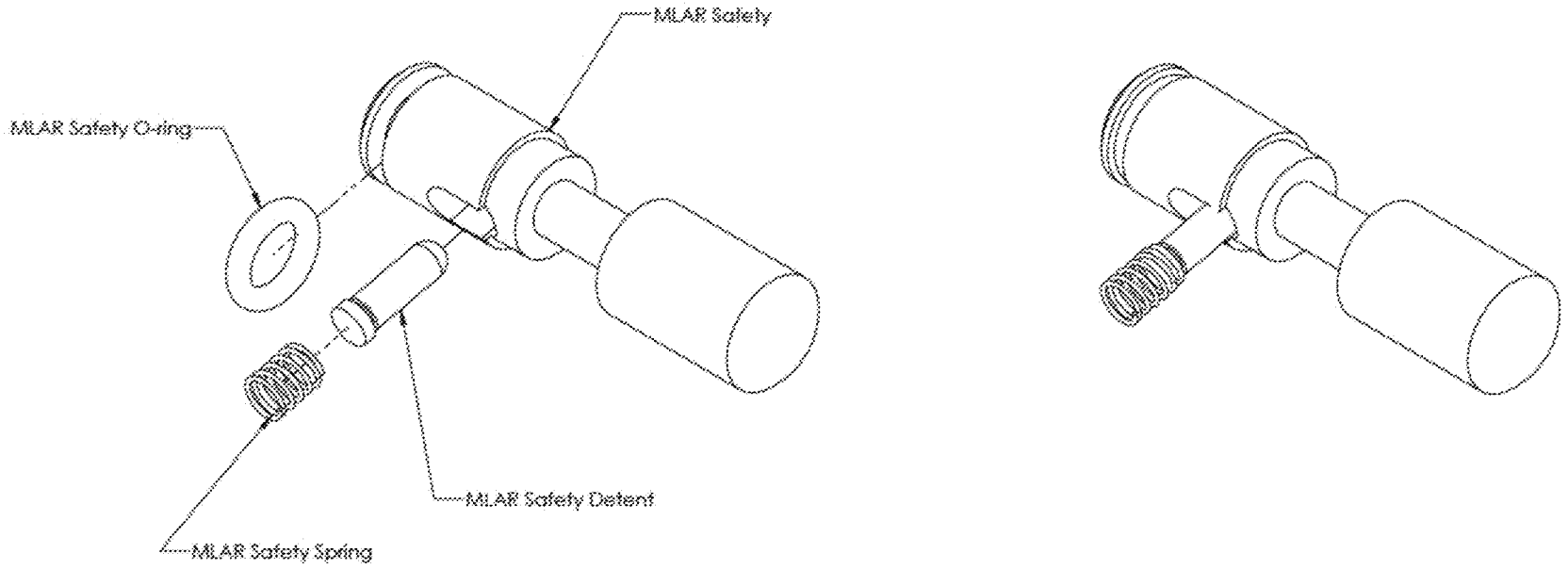

Having thus described the presently disclosed subject matter in general terms, reference will now be made to the accompanying Drawings, which are not necessarily drawn to scale, and wherein:

FIG. 1 is a cross-sectional, side view of a middle portion of a lever action firearm having a linkage assembly for pivotally connecting its action lever to its bolt carrier assembly in accordance with embodiments of the present disclosure;

FIG. 2 a cross-sectional, side view of the firearm shows a result of the trigger being pulled;

FIG. 3 is a cross-sectional, side view of the bolt carrier assembly being in the open position;

FIG. 4 is a cross-sectional, side view of the firearm returned to the closed position;

FIG. 5 is a side view of a lever action firearm;

FIG. 6 is a cross-sectional, side view of a portion of the lever action firearm shown in FIG. 5;

FIGS. 7A-7D are various views of components of the lever action firearm shown in FIGS. 5 and 6;

FIG. 8 is various components of the lever assembly of the lever action firearm shown in FIGS. 5 and 6;

FIG. 9 shows various components of the bolt carrier assembly of the lever action firearm shown in FIGS. 5 and 6;

FIG. 10 is a lower pivot (left and right) of the lever action firearm shown in FIGS. 5 and 6;

FIG. 11 is an upper pivot of the lever action firearm shown in FIGS. 5 and 6;

FIG. 12 is various components of the push button safety of the lever action firearm shown in FIGS. 5 and 6;

FIG. 13 is a side view of another example lever action firearm;

FIG. 14 is a cross-sectional, side view of a portion of the lever action firearm shown in FIG. 13;

FIG. 15 is a side view of a portion of the lever action firearm shown in FIGS. 13 and 14;

FIG. 16 is a top perspective view of a portion of the lever action firearm shown in FIGS. 13 and 14;

FIGS. 17A and 17B are a side view and perspective view of the action lever of the lever action firearm shown in FIGS. 13 and 14;

FIG. 18 shows views of components of the carrier assembly of the lever action firearm shown in FIGS. 13 and 14;

FIG. 19 shows views of pivot links of the carrier assembly of the lever action firearm shown in FIGS. 13 and 14;

FIG. 20 shows views of safety assembly of the lever action firearm shown in FIGS. 13 and 14;

FIG. 21 is a cross-sectional, side view of a middle portion of a lever action firearm having a gear assembly for gear sets connecting its action lever to its bolt carrier assembly in accordance with embodiments of the present disclosure;

FIG. 22 is a cross-sectional, side view of the bolt carrier assembly being in the open position;

FIG. 23 is a side view of the lever action firearm with AR-15 components;

FIG. 24 is a side view of a lever action firearm with MLAR components;

FIG. 25 is a side view of a lever action firearm;

FIG. 26 is a side view of the action lever of the lever action firearm shown in FIGS. 21 and 22;

FIG. 27 are various views of components of the lever action firearm bolt carrier shown in FIGS. 21 and 22;

FIG. 28 shows an isometric view of the modern lever action bolt carrier;

FIG. 29 shows various components of the gear sets that are part of the rack and pinion assembly of the lever action firearm shown in FIGS. 21 and 22; and FIG. 30 shows various components of the push button safety of the lever action firearm shown in FIG. 21.

SUMMARY

The presently disclosed subject matter provides lever action firearms having a linkage assembly for pivotally connecting its action lever to its bolt carrier assembly and associated methods. An example object is to provide a rifle with a middle ground between a traditional lever action and modern AR-15 rifle. What our rifle improves on the traditional lever action is the present subject matter brings a level of customizability that is accustomed to AR-15 allowing end users to switch calibers, triggers, barrels, and muzzle devices with similar ease to an AR-15. Further, the present subject matter provides an alternative to a semi-automatic firearm and allows this firearm to exist in a place where standard AR-15 rifles are regulated.

According to an aspect, a lever action firearm includes an upper frame defining a bolt passage. Further, the lever action firearm includes a bolt carrier assembly received in the upper frame and operable to reciprocate between an open position and a closed position. The bolt carrier assembly includes a first pivot. The lever action firearm includes a lower frame defining a magazine well configured to removably receive a box magazine. Further, the lever action firearm includes an action lever movable between a retracted position and an extended position. The action lever includes second and third pivots. Further, the action lever is pivotally connected to the lower frame at the second pivot. The lever action firearm also includes a linkage assembly is pivotally connected to the action lever at the third pivot, wherein the linkage assembly is pivotally connected to the bolt carrier assembly at the first pivot. The linkage assembly is configured to position the bolt carrier assembly in the closed position when the action lever is in the retracted position. The linkage assembly is configured to position the bolt carrier assembly in the open position when the action lever is in the extended position.

According to another aspect, a lever action firearm including an upper frame defining a bolt passage. A bolt carrier assembly is received in the upper frame and operable to reciprocate between an open position and a closed position. A lower frame defines a magazine well configured to removably receive a box magazine. An action lever is movable between a retracted position and an extended position. The action lever comprises an action lever gear. The action lever is pivotally connected to the lower frame. A gear assembly comprises a first gear set and a second gear set. The gear assembly is mechanically driven by the action lever. The action lever gear is operably connected to the second gear set. The gear assembly is mechanically connected to the bolt carrier assembly at the first gear set. The gear assembly is configured to position the bolt carrier assembly in the closed position when the action lever is in the retracted position. The gear assembly is configured to position the bolt carrier assembly in the open position when the action lever is in the extended position.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

FIG. 1 illustrates a cross-sectional, side view of a middle portion of a lever action firearm 100 having a linkage assembly 102 for pivotally connecting its action lever 104 to its bolt carrier assembly 106 in accordance with embodiments of the present disclosure. Referring to FIG. 1, the firearm 100 includes an upper frame 108 that defines a bolt passage 110. The bolt carrier assembly 106 is received in the upper frame 108 and operable to reciprocate between an open position and a closed position. FIG. 2 illustrates a cross-sectional, side view of the bolt carrier assembly 106 in the closed position, and FIG. 3 illustrates a cross-sectional, side view of the bolt carrier assembly 106 being in the open position.

In the closed position as shown in FIG. 1, the action lever 104 can be locked to a lower receiver 114 via a lever lock 116. Further, in the closed position, the bolt is rotated in the barrel extension and the bolt carrier assembly 106 is against the barrel face. Further, in the closed position, a hammer 118 is reset to a ready-to-fire position as shown in FIG. 1.

With continuing reference to FIG. 1, the firearm 100 includes a lower frame 120. The lower frame 120 defines a magazine well, generally designated 122, configured to removably receive a box magazine 124. The lower frame 120 and the upper frame 108 are removably attached.

The action lever 104 is pivotally movable between a retracted position (as shown in FIGS. 1 and 2) and an extended position (as shown in FIG. 3). For movement between the retracted and extended positions, the action lever 104 has a pivot 126 where it is pivotally connected to the lower frame 120. The action lever 104 also includes another pivot 128 at one end where the action lever 104 is pivotally attached to the linkage assembly 102 as described in more detail below.

The linkage assembly 102 includes two links 132 and 134, which are pivotally connected at pivot 128. Link 132 is also pivotally attached to the upper frame 108 at pivot 136. In this example, link 132 is elongate in shape with opposing ends where pivots 128 and 136 are attached. Also in this example, link 134 is elongate in shape with opposing ends where pivot 128 and another pivot 138 are attached. Pivot 138 is attached to the bolt carrier assembly 106.

It is noted that pivots 128 and 138 are freely movable and their movement controllable by the user's movement of the action lever 104. FIG. 1 shows the positioning of pivots 128 and 138 when the bolt carrier assembly 112 is in the closed position. When the action lever 104 is moved towards its position shown in FIG. 3 (i.e., the extended position), pivot 138 moves rearward in the direction indicated by arrow 140, and pivot 128 moves rearward and downward (downward is indicated by the direction of arrow 142). FIG. 3 shows a final position of pivots 128 and 138 when the action lever 104 is at the extended position.

FIG. 2 illustrates a cross-sectional, side view of the firearm 100 showing a result of the trigger 200 being pulled. Referring to FIG. 2, the hammer 118 releases once the trigger 200 is pulled and moves upward and forward to the position shown in the figure. Due to the movement, the hammer 118 hits a firing pin 202 which in turn hits a primer (not shown) on a loaded rounded. In turn, the round is ignited and its projectile exits the firearm 100 down range.

Subsequent to the firearm 100 firing as depicted in FIG. 2, the user can move the action lever 104 in the direction indicated by arrow 300 to the extended position shown in FIG. 3. Referring now to FIG. 3, as a result of moving the action lever 104 to this position, the bolt carrier assembly 106 is moved rearward. Further, the bolt extractor pulls the spent round out of the chamber and the bolt ejector ejects it. Also, the bolt carrier assembly 106 passes over the hammer 118 to reset it by moving it in the direction indicated by arrow 302.

Subsequent to the action described with respect to FIG. 3, the user can move the action lever 104 back in the direction indicated by arrow 400 as shown in FIG. 4, which illustrates a cross-sectional, side view of the firearm 100 returned to the closed position. Referring to FIG. 4, the user's action of moving the action lever 104 back to the closed position results in the bolt carrier assembly 106 also moving back to the position shown in FIG. 1. The bolt lugs contact the next round in the box magazine 124 and loads the next round in the chamber. Further, the bolt rotates, and the bolt carrier touches the barrel face. The lever lock engages the lower receiver. As a result, the firearm 100 is ready to fire.

In accordance with embodiments, FIG. 5 illustrates a side view of a lever action firearm 100. Referring to FIG. 5, various components are labeled.

FIG. 6 illustrates a cross-sectional, side view of a portion of the lever action firearm 100 shown in FIG. 5. Various components of the firearm 100 are labeled in FIG. 6.

Figure 7A:
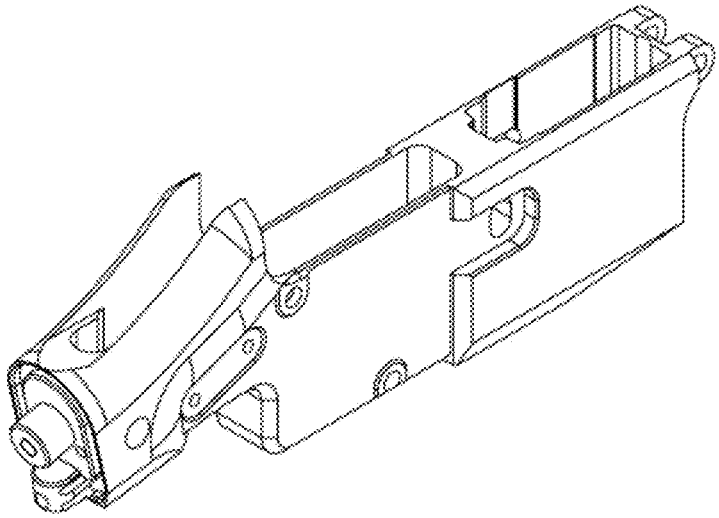
Figure 7B:
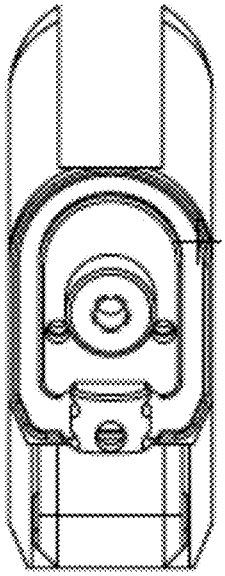
Figure 7C:
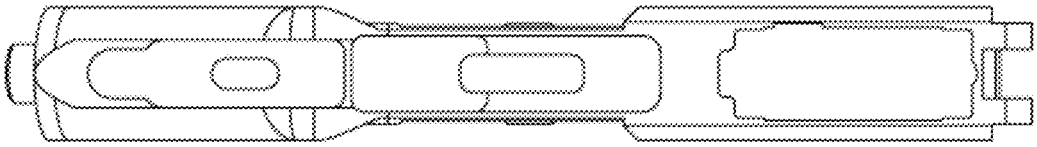
Figure 7D:
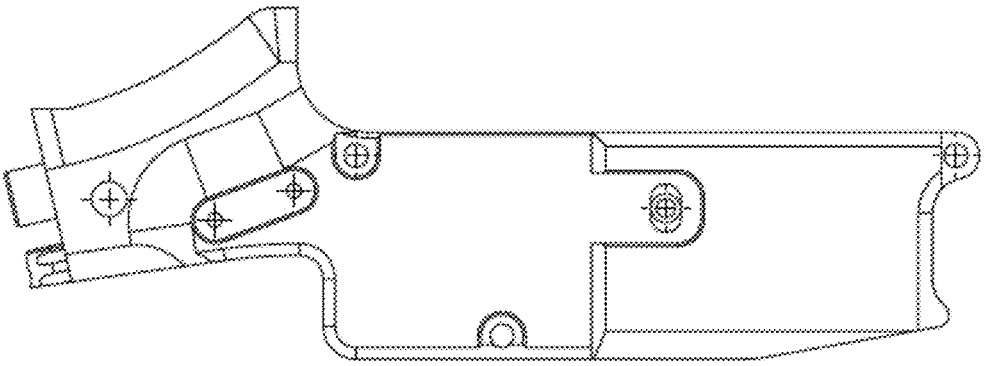

FIGS. 7A-7D illustrate various views of components of the lever action firearm shown in FIGS. 5 and 6. FIG. 7A shows an isometric view of a lever action lower receiver. FIG. 7B shows the rear view of the lever action lower receiver. FIG. 7C shows the top-down view of the lever action lower receiver. FIG. 7D shows the side profile of the lever action lower receiver.

FIG. 8 illustrates various components of the lever assembly of the lever action firearm 100 shown in FIGS. 5 and 6. FIG. 8 shows the subassembly of the lever. It uses the lever lock to hold the lever in the lower receiver when it and the bolt are in the closed position. This lever lock can be overcome with minimal pressure applied to the lever. Furthermore, it shows the dowel that is pressed into the lever that fits in the cam track on the lower pivot pieces.

FIG. 9 illustrates various components of the bolt carrier assembly of the lever action firearm shown in FIGS. 5 and 6. FIG. 9 shows the bolt carrier group for the modern lever action rifle. The bolt carrier dowel is pressed into the bolt carrier, and it is what the upper pivot linkages are set on while they rotate through slot holes cut into the bolt carrier. The AR-15 bolt can be any suitable centerfire rifle AR-15 bolt including, but not limited to, AR-15 (5.56, .223, 300BLK, 350L), 450/458, 6.5 Grendel, 7.62/12.7. The firing pin is a nonstandard firing pin and ignited the cartridge when struck by the hammer. It can be held in the bolt carrier with a fire retaining cotter pin.

FIG. 10 illustrates a lower pivot (left and right) of the lever action firearm shown in FIGS. 5 and 6. FIG. 10 shows the lower pivot components to the modern lever action rifle. In an assembly each rifle will contain one left and one right pivot piece. These pieces are the same design wise but "mirrored". The lower pivot pieces contain a slot cut which the dowel pin in the lever rides in and a peg which the upper pivot pieces sit on.

FIG. 11 illustrates an upper pivot of the lever action firearm shown in FIGS. 5 and 6. FIG. 11 shows the upper pivot component to the modern lever action rifle. Each assembled rifle requires two of these pieces to function correctly. The upper pivot sits on pegs on both the bolt carrier and lower pivot action as a link between them.

FIG. 12 illustrates various components of the push button safety of the lever action firearm shown in FIGS. 5 and 6. This is different than the standard AR-15 safety that is rotated to get from safe to fire, rather this one is pushed. A red rubber o ring is placed on one end so when the safety is pushed, and the user sees the red o ring the firearm can be assumed ready to fire.

In accordance with embodiments, FIG. 13 illustrates a side view of another example lever action firearm. Referring to FIG. 13, various components are labeled.

FIG. 14 illustrates a cross-sectional, side view of a portion of the lever action firearm shown in FIG. 13. Various components are labeled in FIG. 14.

FIG. 15 illustrates a side view of a portion of the lever action firearm shown in FIGS. 13 and 14. Various components are labeled in FIG. 15.

FIG. 16 illustrates a top perspective view of a portion of the lever action firearm shown in FIGS. 13 and 14. FIG. 16 shows an isometric view of these housing components shown in FIG. 15.

FIGS. 17A and 17B illustrate a side view and perspective view of the action lever of the lever action firearm shown in FIGS. 13 and 14.

FIG. 18 illustrates views of components of the carrier assembly of the lever action firearm shown in FIGS. 13 and 14. This figure also depicts the AR-15 cam pin and a completed AR-15 bolt with extractor and ejector included.

FIG. 19 illustrates views of pivot links of the carrier assembly of the lever action firearm shown in FIGS. 13 and 14. FIG. 19 same as FIGS. 10 and 11 but shows these components together as they can be assembled in a rifle.

FIG. 20 illustrates views of safety assembly of the lever action firearm shown in FIGS. 13 and 14. FIG. 20 same as FIG. 12 but shows the extra information of the detent and spring. This detent and spring are important to its function as the detent presses into drill holes in the safety and holds it in a certain position (safe or fire) until the user presses the button to switch it.

The linkage is important to the operation of the lever action rifle as it takes the rotational motion from the lever and brings the bolt carrier assembly sufficiently far rearward to pick up the next round in the magazine. The advantage of previous efforts of lever action rifles is this particular rifle provides similar customizability to an AR-15 with interchangeable bolts, barrels, rails, magazines, and muzzle devices while not using a semiautomatic action that is prohibited in some areas.

In accordance with embodiment, disclosed herein are lever action firearms having a rack and pinion assembly for gears connecting its action lever to its bolt carrier assembly and associated methods. An example object is to provide a rifle with a middle ground between a traditional lever action and modern AR-15 rifle. What our rifle improves on the traditional lever action is the present subject matter brings a level of customizability that is accustomed to AR-15 allowing end users to switch calibers, triggers, barrels, and muzzle devices with similar ease to an AR-15. Further, the present subject matter provides an alternative to a semi-automatic firearm and allows this firearm to exist in a place where standard AR-15 rifles are regulated.

FIG. 21 is a cross-sectional, side view of a middle portion of a lever action firearm 2100 having a gear assembly 2102 for gear sets 2104 and 2106 connecting its action lever 2108 to its bolt carrier assembly 2110 in accordance with embodiments of the present disclosure. Referring to FIG. 21, the gear assembly 2102 and gear sets 2104 and 2106 operate together such that the action lever 2108 can be moved to thereby mechanically drive the bolt carrier assembly 2110. The firearm 2100 includes an upper frame 2112 that defines a bolt passage 2114. The firearm 100 also includes a bolt carrier assembly 2116 received in the upper frame 2112 and operable to reciprocate between an open position and a closed position. FIG. 21 shows the bolt carrier assembly 2116 in the closed position, and FIG. 22 illustrates a cross-sectional, side view of the bolt carrier assembly 2116 being in the open position.

In the closed position as shown in FIG. 21, the action lever 2108 can be locked to a lower receiver 2118 via a lever lock 116. Further, in the closed position, the bolt can be rotated in the barrel extension and the bolt carrier assembly is against the barrel face. Further, in the closed position, a hammer 2122 is reset to it ready to fire position as shown in FIG. 21.

With continuing reference to FIG. 21, the firearm 2100 includes a lower frame 2124. The lower frame 2124 defines a magazine well, generally designated 2126, configured to removably receive a box magazine 2128. The lower frame 120 and the upper frame 2112 are removably attached. The action lever 2108 is pivotally movable between a retracted position (as shown in FIG. 21) and an extended position (as shown in FIG. 22, which illustrates a cross-sectional, side view of the bolt carrier assembly being in the open position). For movement between the retracted and extended positions, the action lever 2108 also includes another gear 128 at one end where the action lever 104 that mechanically drives the assembly 2110 as described in more detail below.

The gear assembly 2102 includes two gear sets 2104 and 2106, which are connected by Chicago bolts to the lower receiver 2118. The action lever 2108 pivotally moves about a pivot 2130 which rotates an action lever gear 2132 in turn mechanically drives gear set 2104, which in turn drives gear set 2106. The gear set 2106 mechanically drives a rack gear 2134 located on the bottom of the bolt carrier assembly 2110, thus the bolt carrier assembly 2110 can reciprocate between an open position and a closed position. Gear sets 2104 and 2106 can rotate about pivots 2136 and 2138, respectively.

It is noted that gear sets 2104 and 2106 are freely rotatable and their movement controllable by the user's movement of the action lever 2108. FIG. 21 shows the positioning of gear sets 2104 and 2106 when the bolt carrier assembly 2110 is in the closed position. When the action lever 104 is moved towards its position shown in FIG. 22 (i.e., the extended position), gear set 2104 rotates clockwise and the gear set 2106 rotates counterclockwise driving the bolt carrier assembly 2110 rearward.

FIG. 23 illustrates a side view of the lever action firearm 2100 with AR-15 components. This figure shows a result of a trigger 2300 being pulled. Referring to FIG. 23, a hammer 2302 can release when the trigger 2300 is pulled. Once the trigger 2300 is pulled, the hammer 2302 moves in the direction of the position shown in FIG. 3. Due to the movement, the hammer 2302 can hit a firing pin which in turn hits a primer (not shown) on a loaded round. In turn, the round is ignited and its projectile sent down range.

Subsequent to the firearm 2100 firing as depicted in FIG. 23, the user can move the action lever 2108 in the direction indicated by its position in FIG. 22. As a result of moving the action lever 2108 to this position, the bolt carrier assembly 2110 is moved rearward. Further, the bolt extractor pulls the spent round out of the chamber and the bolt ejector ejects it. Also, the bolt carrier assembly 2110 passes over the hammer 2302 to reset it.

Subsequent to the action described with respect to FIG. 23, the user can move the action lever 104 back in the direction shown in FIG. 21 where it is returned to the closed position. Referring to FIG. 22, the user's action of moving the action lever 2108 back to the closed position results in the bolt carrier assembly 2110 returning to the forward position. The bolt lugs contact the next round in the box magazine 2128 and loads the next round in the chamber. Further, the bolt rotates, and the bolt carrier touches the barrel face. The lever lock engages the lower receiver. As a result, the firearm 2100 is ready to fire.

FIG. 24 illustrates a side view of a lever action firearm with MLAR components.

FIG. 25 illustrates a side view of a lever action firearm. Referring to FIG. 25, various components are labeled.

FIG. 26 illustrates a side view of the action lever of the lever action firearm shown in FIGS. 21 and 22. FIG. 26 shows the locking lug of the lever. It uses the lever lock to hold the lever in the lower receiver when it and the bolt are in the closed position. This lever lock can be overcome with minimal pressure applied to the lever. Furthermore, it shows the dowel that is pressed into the lever that fits in the cam track on the lower pivot pieces. Various parts are labeled in FIG. 26.

FIG. 27 illustrate various views of components of the lever action firearm bolt carrier shown in FIGS. 21 and 22. FIG. 28 shows an isometric view of the modern lever action bolt carrier.

FIG. 29 illustrates various components of the gear sets that are part of the rack and pinion assembly of the lever action firearm shown in FIGS. 21 and 22.

FIG. 30 illustrates various components of the push button safety of the lever action firearm shown in FIGS. 21. FIG. 30 shows the push button safety of the lever action rifle is different than the standard AR-15 safety that is rotated to get from safe to fire, rather this one is pushed. A red rubber o ring is placed on one end so when the safety is pushed, and the user sees the red o ring the firearm can be assumed ready to fire. FIG. 30 shows the extra information of the detent and spring. This detent and spring are important to its function as the detent presses into drill holes in the safety and holds it in a certain position (safe or fire) until the user presses the button to switch it.

The rack and pinion assembly is important to the operation of the modern lever action rifle as it takes the rotational motion from the lever and brings the bolt carrier group back far enough to pick up the next round in the magazine. The advantage of previous efforts of lever action rifles is this particular rifle provides similar customizability to an AR-15 with interchangeable bolts, barrels, rails, magazines, and muzzle devices while not using a semi-automatic action that is prohibited in some areas.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A lever action firearm comprising:

an upper frame that defines a bolt passage;

a bolt carrier assembly received in the upper frame and operable to reciprocate between an open position and a closed position, wherein the bolt carrier assembly includes a first pivot;

a lower frame defining a magazine well configured to removably receive a box magazine;

an action lever movable between a retracted position and an extended position, wherein the action lever includes second and third pivots, and wherein the action lever is pivotally connected to the lower frame at the second pivot; and a linkage assembly is pivotally connected to the action lever at the third pivot, wherein the linkage assembly is pivotally connected to the bolt carrier assembly at the first pivot, wherein the linkage assembly is configured to position the bolt carrier assembly in the closed position when the action lever is in the retracted position, and wherein the linkage assembly is configured to position the bolt carrier assembly in the open position when the action lever is in the extended position, wherein the linkage assembly comprises a first link and a second link, and wherein the first link and the second link are pivotally attached at the third pivot.

2. The lever action firearm of claim 1, further comprising a fourth pivot attached to the upper frame, wherein the first link comprises a first end and a second end, wherein the first end of the first link is attached to the fourth pivot, and wherein the second end of the first link is attached to the third pivot.

3. The lever action firearm of claim 2, wherein the first link is elongate in shape.

4. The lever action firearm of claim 1, wherein the second link comprises a first end and a second end, wherein the first end of the second link is attached to the first pivot, and wherein the second end of the second link is attached to the third pivot.

5. The lever action firearm of claim 4, wherein the second link is elongate in shape.

6. The lever action firearm of claim 1, wherein the action lever drives the third pivot rearward when moved from the retracted position to the extended position.

7. The lever action firearm of claim 1, wherein the action lever moves the first pivot rearward and bolt carrier assembly rearward when moved from the retracted position to the extended position.

8. A lever action firearm comprising:

an upper frame defining a bolt passage;

a bolt carrier assembly received in the upper frame and operable to reciprocate between an open position and a closed position;

a lower frame defining a magazine well configured to removably receive a box magazine;

an action lever movable between a retracted position and an extended position, wherein the action lever comprises an action lever gear, and wherein the action lever is pivotally connected to the lower frame;

a gear assembly comprising a first gear set and a second gear set, wherein the gear assembly is mechanically driven by the action lever, wherein the action lever gear is operably connected to the second gear set, wherein the gear assembly is mechanically connected to the bolt carrier assembly at the first gear set, wherein the gear assembly is configured to position the bolt carrier assembly in the closed position when the action lever is in the retracted position, and wherein the gear assembly is configured to position the bolt carrier assembly in the open position when the action lever is in the extended position.

9. The lever action firearm of claim 8, further comprising a first pivot and a second pivot, and wherein the first gear set and the second gear set are rotatable about the first pivot and the second pivot, respectively.

10. The lever action firearm of claim 9, wherein the first gear set and the second gear set are operably connected such that rotation of the first gear set drives rotation of the second gear set.

11. The lever action firearm of claim 9, wherein rotation of the action lever about its pivot causes the first gear set to rotate.

12. The lever action firearm of claim 9, wherein rotation of the action lever about its pivot causes the first gear set to rotate to thereby cause the second gear set to rotate.

13. The lever action firearm of claim 9, wherein rotation of the action lever about its pivot causes the first gear set to rotate to thereby cause the second gear set to rotate and cause the bolt carrier assembly to move.

14. The lever action firearm of claim 8, further comprising a rack gear attached to the bolt carrier assembly, and wherein the gear assembly is operably connected to the rack gear such that operational movement of the gear assembly drives the rack gear to effect movement of the bolt carrier assembly.

15. The lever action firearm of claim 14, wherein movement of the action lever between the retracted position and the extended position moves the gear assembly to drive the rack gear for moving the bolt carrier assembly.

16. The lever action firearm of claim 8, further comprising a hammer, and wherein in the closed position, the hammer is reset to a ready to fire position.

17. The lever action firearm of claim 13, further comprising a trigger configured to cause the hammer to release when the trigger is pulled.

* * * * *